US005126227A

United States Patent [19]

Machonkin et al.

[11] Patent Number: 5,126,227

[45] Date of Patent: Jun. 30, 1992

[54] HIGH CONTRAST PHOTOGRAPHIC ELEMENTS CONTAINING BALLASTED HYDROPHOBIC ISOTHIOUREAS

[75] Inventors: Harold I. Machonkin, Webster; Donald L. Kerr, Rochester, both of N.Y.

[73] Assignee: Eastman Kodak Company, Rochester, N.Y.

[21] Appl. No.: 599,218

[22] Filed: Oct. 17, 1990

[51] Int. Cl.[5] ..... G03C 1/34; G03C 5/26

[52] U.S. Cl. ..... 430/264; 430/598; 430/611

[58] Field of Search ..... 430/264, 611, 598

[56] References Cited

U.S. PATENT DOCUMENTS

| | | | |
|---|---|---|---|
| 3,220,839 | 3/1965 | Herz et al. | 430/611 |
| 4,166,742 | 7/1979 | Mifune et al. | 96/107 |
| 4,272,606 | 10/1981 | Mifune et al. | 430/264 |
| 4,800,150 | 9/1989 | Katoh | 430/264 |
| 4,824,774 | 7/1989 | Inoue et al. | 430/566 |
| 4,914,003 | 12/1990 | Yagihara et al. | 430/264 |
| 4,975,354 | 12/1990 | Machonkin et al. | 430/264 |
| 4,988,604 | 1/1991 | Machonkin et al. | 430/264 |
| 4,994,365 | 2/1991 | Looker et al. | 430/264 |

FOREIGN PATENT DOCUMENTS

| | | |
|---|---|---|
| 0226184 | 1/1987 | European Pat. Off. . |
| 0356801 | 6/1990 | European Pat. Off. . |

*Primary Examiner*—Richard L. Schilling
*Attorney, Agent, or Firm*—Alfred P. Lorenzo

[57] ABSTRACT

Silver halide photographic elements which are capable of high contrast development, when processed in the presence of a hydrazine compound that functions as a nucleating agent, contain both an amino compound which functions as an incorporated booster and a ballasted hydrophobic isothiourea compound comprising a ballasting group, that is attached to the sulfur atom, which serves to restrict the mobility of the compound and thereby aid in retaining it in the photographic element during development. The ballasted hydrophobic isothiourea compound is highly effective in reducing pepper fog and also serves to restrain image spread.

28 Claims, No Drawings

HIGH CONTRAST PHOTOGRAPHIC ELEMENTS CONTAINING BALLASTED HYDROPHOBIC ISOTHIOUREAS

FIELD OF THE INVENTION

This invention relates in general to photography and in particular to novel black-and-white photographic elements. More specifically, this invention relates to novel silver halide photographic elements, such as lithographic films used in the field of graphic arts, which are capable of high contrast development and to an improved process for the development of such elements.

BACKGROUND OF THE INVENTION

High contrast development of lithographic films has been carried out for many years using special developers which are known in the art as "lith" developers. In conventional "lith" developers, high contrast is achieved using the "lith effect" (also referred to as infectious development) as described by J. A. C. Yule in the Journal of the Franklin Institute, Vol. 239, 221-230, (1945). This type of development is believed to proceed autocatalytically. To achieve "lith effect" development, a low, but critical, concentration of free sulfite ion is maintained by use of an aldehyde bisulfite adduct, such as sodium formaldehyde bisulfite, which, in effect, acts as a sulfite ion buffer. The low sulfite ion concentration is necessary to avoid interference with the accumulation of developing agent oxidation products, since such interference can result in prevention of infectious development. The developer typically contains only a single type of developing agent, namely, a developing agent of the dihydroxybenzene type, such as hydroquinone.

Conventional "lith" developers suffer from serious deficiencies which restrict their usefulness. For example, the developer exhibits low capacity as a result of the fact that it contains hydroquinone as the sole developing agent. Also, the aldehyde tends to react with the hydroquinone to cause undesirable changes in development activity. Furthermore, the low sulfite ion concentration is inadequate to provide effective protection against aerial oxidation. As a result, a conventional "lith" developer is lacking in stability and tends to give erratic results depending on the length of time that it has been exposed to the air.

An alternative to the use of conventional "lith" developers is disclosed in Nothnagle, U.S. Pat. No. 4,269,929, "High Contrast Development Of Photographic Elements", issued May 26, 1981, the disclosure of which is incorporated herein by reference. As described in this patent, high contrast development of photographic elements is carried out in the presence of a hydrazine compound with an aqueous alkaline developing solution which has a pH of above 10 and below 12 and contains a dihydroxybenzene developing agent, a 3-pyrazolidone developing agent, a sulfite preservative, and a contrast-promoting amount of an amino compound. The developing solution combines the advantages of high capacity, a high degree of stability, and a long effective life, while providing excellent contrast and speed characteristics.

In this art, the hydrazine compounds are typically referred to as "nucleators" or "nucleating agents" and the amino compounds which function to enhance contrast are referred to as "boosters".

U.S. Pat. No. 4,269,929 describes the use of a very wide variety of amino compounds as contrast-promoting agents. In particular, it discloses the use of both inorganic amines, such as the hydroxylamines, and organic amines, including aliphatic amines, aromatic amines, cyclic amines, mixed aliphatic-aromatic amines, and heterocyclic amines. Primary, secondary and tertiary amines, as well as quaternary ammonium compounds, are included within the broad scope of the disclosure.

While the invention of U.S. Pat. No. 4,269,929 represents a very important advance in the art, its commercial utilization has been hindered by the disadvantageous characteristics exhibited by many amino compounds. Thus, for example, some amines suffer from the problem of toxicity, some from the problem of excessive volatility, some are characterized by highly unpleasant odors, some tend to form azeotropes with water, some exhibit an inadequate degree of solubility in an aqueous alkaline photographic developing solution, and some are costly yet must be used at a relatively high concentration such that they constitute a substantial portion of the total cost of the developing solution. Moreover, many amines exhibit a degree of activity as contrast-promoters in the method and composition of U.S. Pat. No. 4,269,929 that is less than is desired for commercial operation.

High contrast developing compositions which contain amino compounds as "boosters" and are intended for carrying out development in the presence of a hydrazine compound are also disclosed in U.S. Pat. Nos. 4,668,605 issued May 26, 1987 and 4,740,452 issued Apr. 26, 1988 and in Japanese Patent Publication No. 211647/87 published Sep. 17, 1987. U.S. Pat. No. 4,668,605 describes developing compositions containing a dihydroxybenzene, a p-aminophenol, a sulfite, a contrast-promoting amount of an alkanolamine comprising an hydroxyalkyl group of 2 to 10 carbon atoms, and a mercapto compound. The developing compositions of U.S. Pat. No. 4,740,452 contain a contrast-promoting amount of certain trialkyl amines, monoalkyl-dialkanolamines or dialkylmonoalkanol amines. The developing compositions of Japanese Patent Publication No. 211647/87 contain a dihydroxybenzene developing agent, a sulfite and certain amino compounds characterized by reference to their partition coefficient values. However, the developing compositions of U.S. Pat. Nos. 4,668,605 and 4,740,452 and Japanese Patent Publication No. 211647/87 do not fully meet the needs of this art, as they exhibit many disadvantageous characteristics. These include the need to use the contrast-promoting agent in such large amounts as to add greatly to the cost of the process and the many difficult problems that stem from the volatility and odor-generating characteristics of amino compounds that are effective to enhance contrast.

The inherent disadvantages of incorporating amino compounds as "boosters" in developing compositions have been recognized in the prior art, and proposals have been made heretofore to overcome the problems by incorporating the amino compound in the photographic element. In particular, the use of amino compounds as "incorporated boosters" has been proposed in Japanese Patent Publication No. 140340/85 published Jul. 25, 1985 and in Japanese Patent Publication No. 222241/87 published Sep. 30, 1987, and corresponding U.S. Pat. No. 4,914,003 issued Apr. 3, 1990. In Publication No. 140340/85, it is alleged that any amino compound can be utilized as an "incorporated booster", while Publication No. 222241/87 is directed to use as "incorporated boosters" of amino compounds defined by a specific structural formula. Publication No. 222241/87 points to some of the problems involved in following the teachings of Publication No. 140340/85 including problems relating to leaching of the amino compounds from the element during development and the generation of "pepper fog".

A photographic system depending on the conjoint action of hydrazine compounds which function as "nucleators" and amino compounds which function as "boosters" is an exceedingly complex system. It is influenced by both the composition and concentration of the "nucleator" and the "booster" and by many other factors including the pH and composition of the developer and the time and temperature of development. The goals of such a system include the provision of enhanced speed and contrast, together with excellent dot quality and low pepper fog.

The goal of achieving low pepper fog is one which is exceptionally difficult to achieve without sacrificing other desired properties such as speed and contrast. (The term "pepper fog" is commonly utilized in the photographic art, and refers to fog of a type characterized by numerous fine black specks). A particularly important film property is "discrimination", a term which is used to describe the ratio of the extent of shoulder development to pepper fog level. Good discrimination, i.e., full shoulder development with low pepper fog, is necessary to obtain good halftone dot quality.

Herz et al, U.S. Pat. No. 3,220,839 issued Nov. 30, 1965, describes the incorporation of certain isothioureas in photographic emulsions to prevent incubation fog. The photographic elements utilizing these emulsions do not contain a hydrazine compound that functions as a nucleating agent nor an incorporated booster and are not subject to pepper fog formation.

Mifune et al, U.S. Pat. No. 4,272,606 issued Jun. 9, 1981, describes a high contrast silver halide photographic element containing a contrast enhancing arylhydrazide and, as an agent which increases sensitivity and contrast, a compound having a thioamido moiety in the molecule thereof. The photographic element does not contain an amino compound that functions as an incorporated booster, nor is such amino compound incorporated in the developing solution.

European Patent Application No. 0226184 published Jun. 24, 1987 is concerned primarily with pepper-fog-reducing and image-spread-restraining compounds intended to be incorporated in a developing solution and describes the use of certain isothiourea compounds and certain free mercapto-compounds for this purpose. The photographic elements described do not contain an amino compound that functions as an incorporated booster, but an amino compound is preferably incorporated in the developing solution. While incorporation of the isothiourea compounds and free mercapto-compounds in the photographic element is also disclosed, there is no teaching relating to use of these compounds in a photographic element that contains an incorporated booster. Moreover, the isothiourea compounds described are characterized by features such as the presence of solubilizing groups, which adapt them for most effective use in a developing solution and make them unsuitable for incorporation in a photographic element.

It is toward the objective of providing a hydrazide-nucleated high contrast silver halide photographic element, containing an incorporated booster, which is capable of providing very low levels of pepper fog, without unduly sacrificing speed, practical density point or contrast, that the present invention is directed.

SUMMARY OF THE INVENTION

The present invention provides novel silver halide photographic elements adapted to form a high contrast image when development is carried out, in the presence of a hydrazine compound which functions as a nucleating agent, with an aqueous alkaline developing solution; the element comprising an amino compound which functions as an incorporated booster and, in an amount effective to inhibit pepper fog without unduly decreasing speed, contrast or practical density point, a ballasted hydrophobic isothiourea compound comprising a ballasting group, that is attached to the sulfur atom, which serves to restrict the mobility of the compound and thereby aid in retaining it in the photographic element during development.

The ballasted hydrophobic isothiourea compounds have been found to be uniquely effective in inhibiting pepper fog and to also serve very effectively to restrain image spread. Since the isothioureas used in this invention are ballasted hydrophobic compounds which are intended to be retained in the photographic element during development, the presence in the ballast of solubilizing groups, such as carboxy or sulfonate groups, is highly disadvantageous and should be avoided.

Isothiourea compounds useful in this invention have a partition coefficient, as hereinafter defined, of at least one and preferably at least three. Preferred isothiourea compounds of this type are represented by the formula:

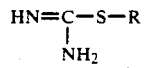

wherein R is a ballasting group that contains at least six carbon atoms, and is substantially free of solubilizing groups.

The invention also includes within its scope the method of high contrast development in which a photographic element, containing both an amino compound which functions as an incorporated booster and a ballasted hydrophobic isothiourea compound which functions to inhibit pepper fog, is developed in the presence of a hydrazine compound, that functions as a nucleator, with an aqueous alkaline photographic developing composition.

DESCRIPTION OF THE PREFERRED EMBODIMENTS

Development of the novel photographic elements of this invention is carried out in the presence of a hydrazine compound. To achieve the benefits of the invention, the hydrazine compound can be incorporated in the photographic element or in the developing solution, the essential requirement being that it be present during development of the exposed element. Incorporation of a hydrazine compound in both the photographic element and in the developing solution is, of course, a further alternative that can be utilized where it is desired to do so.

As used herein, the term "a hydrazine compound" is intended to include hydrazine and hydrazine derivatives, including those which are suited for incorporation in developing solutions and those which are suited for incorporation in photographic elements.

Any hydrazine compound that functions as a "nucleator" and is capable of acting conjointly with the "incorporated booster" of this invention to provide high contrast, can be used in the practice of this invention. The contrast or "gamma" of a photographic element refers to the rate of change of density with exposure and is measured by the slope of the straight line portion of the characteristic curve. The photographic elements of this invention typically exhibit very high contrast, by which is meant a gamma of greater than 10.

Hydrazine ($H_2N—NH_2$) is an effective contrast-promoting agent which can be incorporated in the developing solution in carrying out the method of this invention. As an alternative to the use of hydrazine, any of a wide variety of water-soluble hydrazine derivatives can be added to the developing solution. Preferred hydrazine derivatives for use in the developing solution include organic hydrazine compounds of the formula:

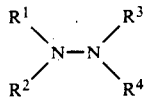

where $R^1$ is an organic radical and each of $R^2$, $R^3$ and $R^4$ is a hydrogen atom or an organic radical. Organic radicals represented by $R^1$, $R^2$, $R^3$ and $R^4$ include hydrocarbyl groups such as an alkyl group, an aryl group, an aralkyl group, an alkaryl group, and an alicyclic group, as well as hydrocarbyl groups substituted with substituents such as alkoxy groups, carboxy groups, sulfonamido groups, and halogen atoms.

Particularly preferred hydrazine derivatives for incorporation in the developing solution include alkylsulfonamido aryl hydrazines such as p-(methylsulfonamido)phenylhydrazine and alkylsulfonamidoalkyl aryl hydrazines such as p-(methylsulfonamidomethyl)-phenylhydrazine.

In the practice of this invention, it is preferred that the hydrazine compound be incorporated in the photographic element. For example, it can be incorporated in a silver halide emulsion used in forming the photographic element. Alternatively, the hydrazine compound can be present in a hydrophilic colloid layer of the photographic element, preferably a hydrophilic colloid layer which is coated to be contiguously adjacent to the emulsion layer in which the effects of the hydrazine compound are desired. It can, of course, be present in the photographic element distributed between or among emulsion and hydrophilic colloid layers, such as undercoating layers, interlayers and overcoating layers.

Photographic elements which are particularly preferred for use in the method of this invention include elements containing a hydrazine compound of the formula:

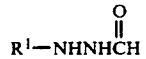

wherein $R^1$ is a phenyl nucleus having a Hammett sigma value-derived electron withdrawing characteristic of less than +0.30.

In the above formula, $R^1$ can take the form of a phenyl nucleus which is either electron donating (electropositive) or electron withdrawing (electronegative); however, phenyl nuclei which are highly electron withdrawing produce inferior nucleating agents. The electron withdrawing or electron donating characteristic of a specific phenyl nucleus can be assessed by reference to Hammett sigma values. The phenyl nucleus can be assigned a Hammett sigma value-derived electron withdrawing characteristic which is the algebraic sum of the Hammett sigma values of its substituents (i.e., those of the substituents, if any, to the phenyl group). For example, the Hammett sigma values of any substituents to the phenyl ring of the phenyl nucleus can be determined algebraically simply by determining from the literature the known Hammett sigma values for each substituent and obtaining the algebraic sum thereof. Electron donating substituents are assigned negative sigma values. For example, in one preferred form, $R^1$ can be a phenyl group which is unsubstituted. The hydrogens attached to the phenyl ring each have a Hammett sigma value of 0 by definition. In another form, the phenyl nuclei can include halogen ring substituents. For example, ortho- or para-chloro or fluoro substituted phenyl groups are specifically contemplated, although the chloro and fluoro groups are each mildly electron withdrawing.

Preferred phenyl group substituents are those which are not electron withdrawing. For example, the phenyl groups can be substituted with straight or branched chain alkyl groups (e.g., methyl, ethyl, n-propyl, isopropyl, n-butyl, isobutyl, n-hexyl, n-octyl, tert-octyl, n-decyl, n-dodecyl and similar groups). The phenyl groups can be substituted with alkoxy groups wherein the alkyl moieties thereof can be chosen from among the alkyl groups described above. The phenyl groups can also be substituted with acylamino groups. Illustrative acylamino groups include acetylamino, propanoylamino, butanoylamino, octanoylamino, benzoylamino, and similar groups.

In one particularly preferred form the alkyl, alkoxy and/or acylamino groups are in turn substituted with a conventional photographic ballast, such as the ballasting moieties of incorporated couplers and other immobile photographic emulsion addenda. The ballast groups typically contain at least eight carbon atoms and can be selected from both aliphatic and aromatic relatively unreactive groups, such as alkyl, alkoxy, phenyl, alkylphenyl, phenoxy, alkylphenoxy and similar groups.

The alkyl and alkoxy groups, including ballasting groups, if any, preferably contain from 1 to 20 carbon atoms, and the acylamino groups, including ballasting groups, if any, preferably contain from 2 to 21 carbon atoms. Generally, up to about 30 or more carbon atoms in these groups are contemplated in their ballasted form. Methoxyphenyl, tolyl (e.g., p-tolyl and m-tolyl) and ballasted butyramidophenyl nuclei are specifically preferred.

Examples of the specifically preferred hydrazine compounds are the following:

1-Formyl-2-(4-[2-(2, 4-di-tert-pentylphenoxy)-butyramido]phenyl)hydrazine

-continued

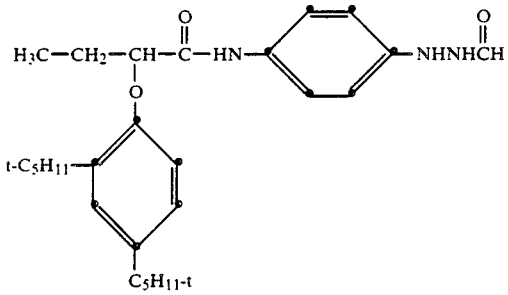

1-Formyl-2-phenylhydrazine

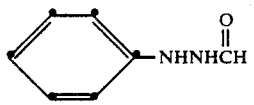

1-Formyl-2-(4-methoxylphenyl)hydrazine

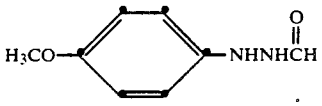

1-Formyl-2-(4-chlorophenyl)hydrazine

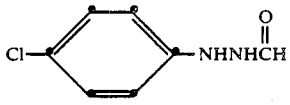

1-Formyl-2-(4-fluorophenyl)hydrazine

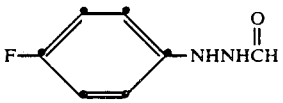

1-Formyl-2-(2-chlorophenyl)hydrazine

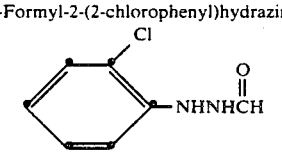

1-Formyl-2-(p-tolyl)hydrazine

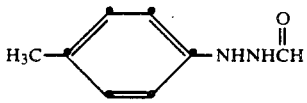

Preferred photographic elements for use in the method of this invention also include those in which the hydrazide comprises an adsorption promoting moiety. Hydrazides of this type contain an unsubstituted or mono-substituted divalent hydrazo moiety and an acyl moiety. The adsorption promoting moiety can be chosen from among those known to promote adsorption of photographic addenda to silver halide grain surfaces. Typically, such moieties contain a sulfur or nitrogen atom capable of complexing with silver or otherwise exhibiting an affinity for the silver halide grain surface. Examples of preferred adsorption promoting moieties include thioureas, heterocyclic thioamides and triazoles. Exemplary hydrazides containing an adsorption promoting moiety include:

1-[4-(2-formylhydrazino)phenyl]-3-methyl thiourea

3-[4-(2-formylhydrazino)phenyl-5-(3-methyl-2-benzoxazolinylidene)rhodanine-6-([4-(2-formylhydrazino)-phenyl]ureylene)-2-methylbenzothiazole N-(benzotriazol-5-yl)-4-(2-formylhydrazino)-phenylacetamide N-(benzotriazol-5-yl)-3-(5-formylhydrazino-2-methoxyphenyl)propionamide and N-2-(5,5-dimethyl-2-thiomidazol-4-yl-idenimino)ethyl-3-[5-(formylhydrazino)-2-methoxyphenyl]propionamide.

Hydrazine compounds incorporated in the developing solution in the practice of this invention are effective at very low levels of concentration. For example, hydrazine gives effective results in the developing solution in an amount of only 0.1 grams per liter. Hydrazine compounds incorporated in the photographic element are typically employed in a concentration of from about $10^{-4}$ to about $10^{-1}$ mole per mole of silver, more preferably in an amount of from about $5\times10^{-4}$ to about $5\times10^{-2}$ mole per mole of silver, and most preferably in an amount of from about $8\times10^{-4}$ to about $5\times10^{-3}$ mole per mole of silver. The hydrazines containing an adsorption promoting moiety can be used at a level as low as about $5\times10^{-6}$ mole per mole of silver.

An especially preferred class of hydrazine compounds for use in the elements of this invention are the hydrazine compounds described in Machonkin et al, U.S. Pat. No. 4,912,016 issued Mar. 27, 1990. These compounds are aryl hydrazides of the formula:

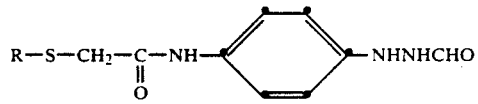

where R is an alkyl or cycloalkyl group.

Another especially preferred class of hydrazine compounds for use in the elements of this invention are the hydrazine compounds described in copending commonly assigned U.S. patent application Ser. No. 167,814, "High Contrast Photographic Element and Emulsion and Process for Their Use", by J. J. Looker, R. E. Leone and L. J. Fleckenstein, filed Mar. 14, 1988. The disclosure of this application is incorporated herein by reference in its entirety.

The hydrazine compounds described in the aforesaid patent application Ser. No. 167,814 have one of the following structural formulae:

I

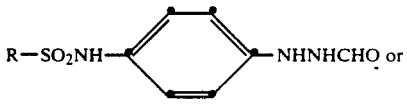

II

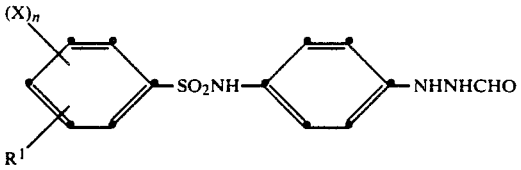

wherein;

R is alkyl having from 6 to 18 carbon atoms or a heterocylic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or —$NHCOR^2$, —$NHSO_2R^2$, —$CONR^2R^3$ or —$SO_2R^2R^3$ where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to about 4 carbon atoms, halogen atoms (e.g. chlorine and fluorine), or —$NHCOR^2$ or —$NHSO_2R^2$ where $R^2$ is as defined above. Preferred R alkyl groups contain from about 8 to about 16 carbon atoms since alkyl groups of this size impart a greater degree of insolubility to the hydrazide nucleating agents and thereby reduce the tendency of these agents to be leached during development from the layers in which they are coated into developer solutions.

Heterocyclic groups represented by R include thienyl and furyl, which groups can be substituted with alkyl having from 1 to about 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to about 4 carbon atoms, halogen atoms (e.g. chlorine or fluorine); or —$NHCOR^2$— or —$NHSO_2R^2$ where $R^2$ is as defined above. Preferred alkyl or alkoxy groups contain from 1 to 5 carbon atoms in order to impart sufficient insolubility to the hydrazide nucleating agents to reduce their tendency to being leached out of the layers in which they are coated by developer solution.

Alkyl, thioalkyl and alkoxy groups which are represented by X contain from 1 to about 5 carbon atoms and can be straight or branched chain. When X is halogen, it may be chlorine, fluorine, bromine or iodine. Where more than one X is present, such substituents can be the same or different.

Representative examples of hydrazide nucleating agents within the scope of the aforesaid patent application Ser. No. 167,814 include:

Compound No.

1.

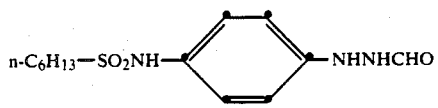

2.

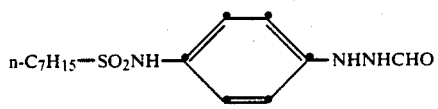

3.

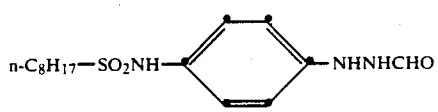

4.

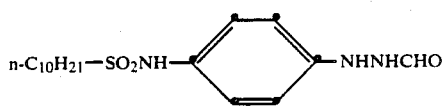

5.

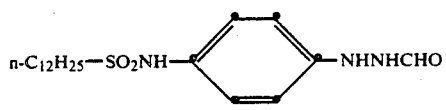

6.

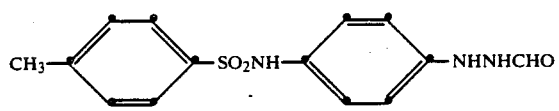

7.

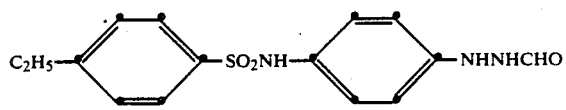

8.

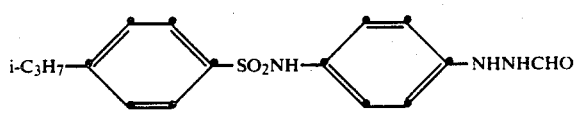

-continued

Compound No.

9.

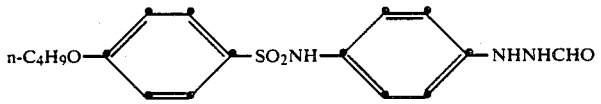

10.

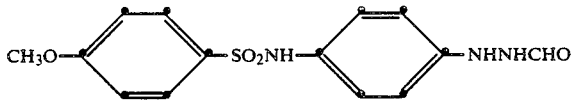

11.

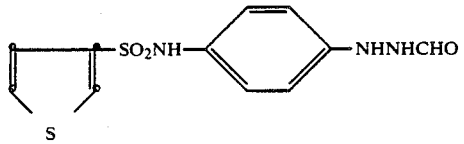

12.

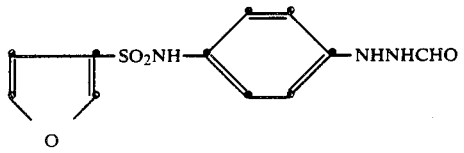

13.

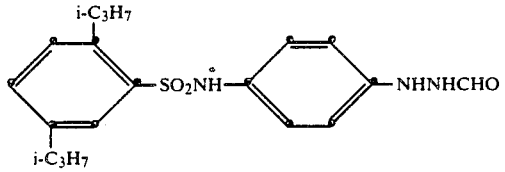

14.

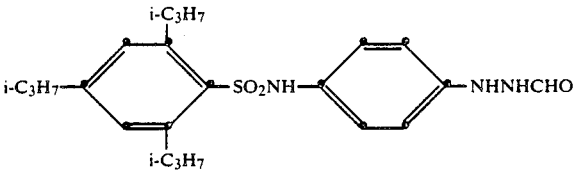

15.

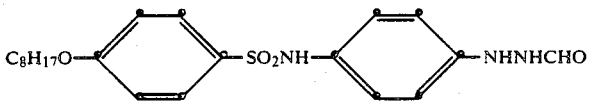

16.

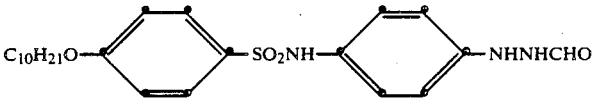

17.

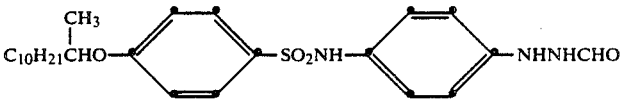

18.

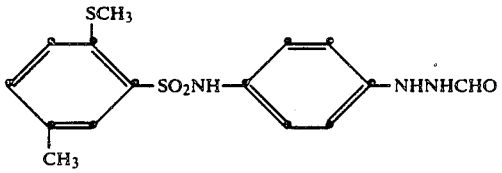

The hydrazide compounds described above can be prepared, for example, by reducing 1-formyl-2-(4-nitrophenyl)-hydrazide to the corresponding amine which is then caused to react with an alkyl- or an aryl- sulfonyl halide compound to form the desired sulfonamidophenyl hydrazide.

Yet another especially preferred class of hydrazine compounds are aryl sulfonamidophenyl hydrazides containing ethyleneoxy groups which have the formula:

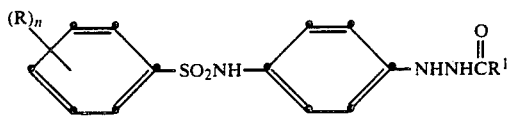

II where each R is a monovalent group comprised of at least three repeating ethyleneoxy units, n is 1 to 3, and $R^1$ is hydrogen or a blocking group.

These hydrazides are described in copending commonly assigned U.S. patent application Ser. No. 528,651, "High Contrast Photographic Element Including An Aryl Sulfonamidophenyl Hydrazide Containing Ethyleneoxy Groups", by H. I. Machonkin and D. L. Kerr, filed May 24, 1990 and issued Aug. 20, 1991 as U.S. Pat. No. 5,041,355.

Still another especially preferred class of hydrazine compounds are aryl sulfonamidophenyl hydrazides containing both thio and ethyleneoxy groups which have the formula:

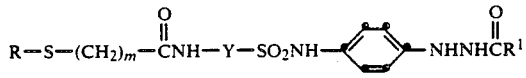

where R is a monovalent group comprised of at least three repeating ethyleneoxy units, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl.

These hydrazides are described in copending commonly assigned U.S. patent application Ser. No. 528,650, "High Contrast Photographic Element Including An Aryl Sulfonamidophenyl Hydrazide Containing Both Thio And Ethyleneoxy Groups", by H. I. Machonkin and D. L. Kerr, filed May 24, 1990 and issued Jan. 29, 1991 as U.S. Pat. No. 4,988,604.

The most preferred class of hydrazine compounds for use in the elements of this invention are aryl sulfonamidophenyl hydrazides containing an alkyl pyridinium group which have the formula:

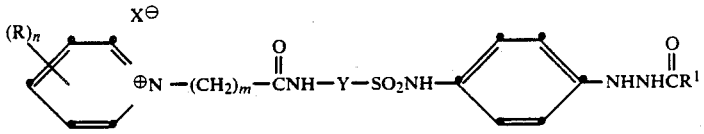

where each R is an alkyl group, preferably containing 1 to 12 carbon atoms, n is 1 to 3, X is an anion such as chloride or bromide, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl. Preferably, the sum of the number of carbon atoms in the alkyl groups represented by R is at least 4 and more preferably at least 8. The blocking group represented by $R^1$ can be, for example:

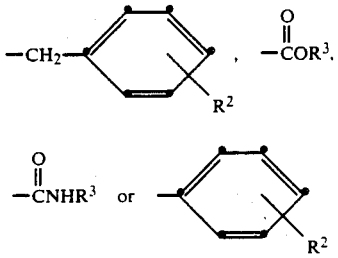

where $R^2$ is hydroxy or a hydroxy-substituted alkyl group having from 1 to 4 carbon atoms and $R^3$ is an alkyl group having from 1 to 4 carbon atoms.

These hydrazides are described in copending commonly assigned U.S. patent application Ser. No. 528,628, "High Contrast Photographic Element Including An Aryl Sulfonamidophenyl Hydrazide Containing An Alkyl Pyridinium Group", by J. J. Looker and D. L. Kerr, filed May 24, 1990 and issued Feb. 19, 1991 as U.S. Pat. No. 4,994,365.

Examples of aryl sulfonamidophenyl hydrazides containing an alkyl pyridinium group include the following:

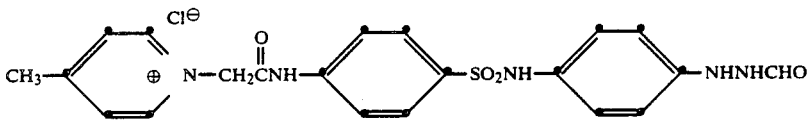

I-1

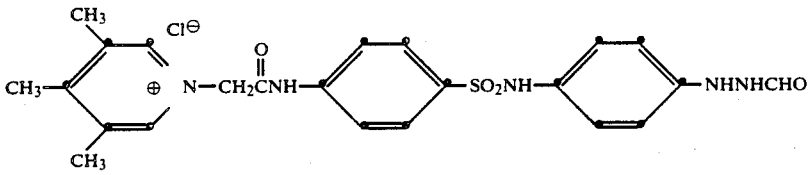

I-2

-continued
I-3
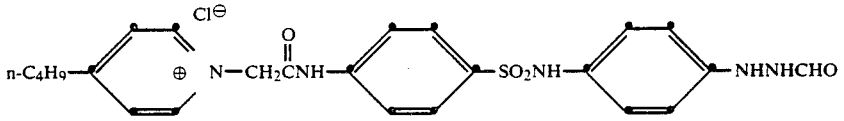
I-4
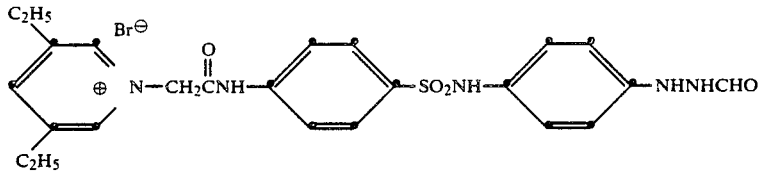
I-5
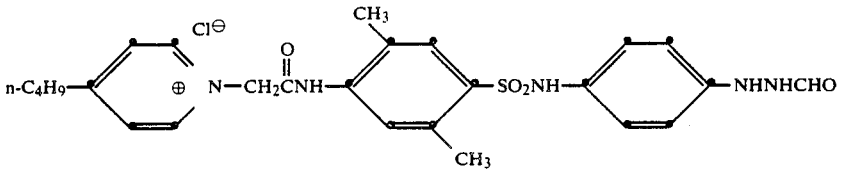
I-6
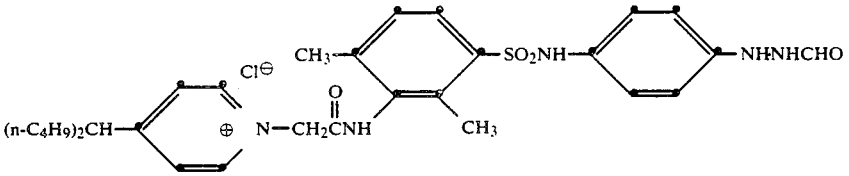
I-7
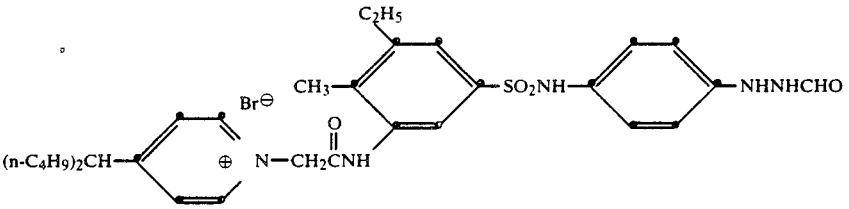
I-8
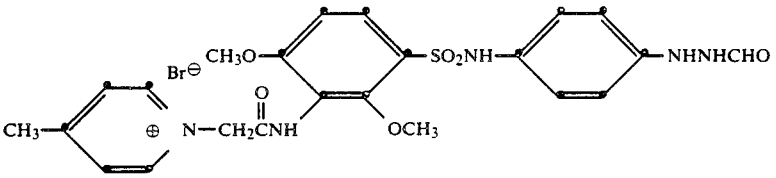
I-9
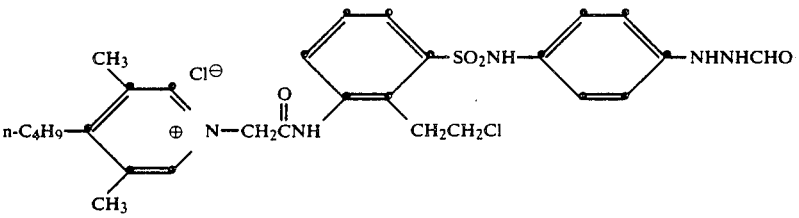
I-10
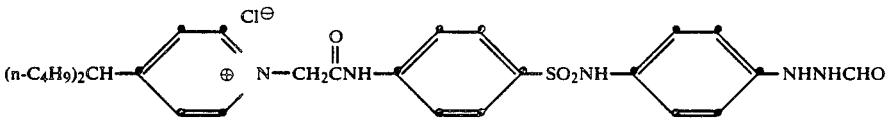
I-11
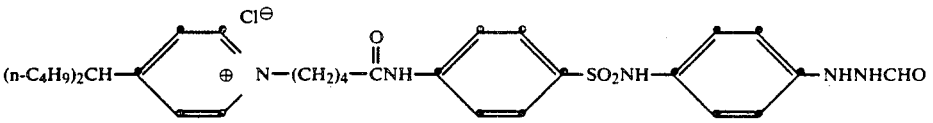

-continued

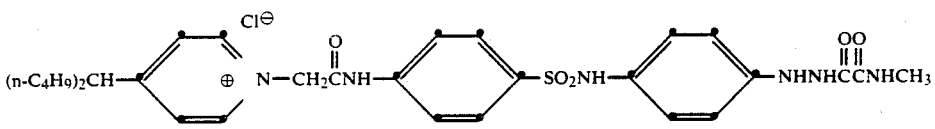

I-12

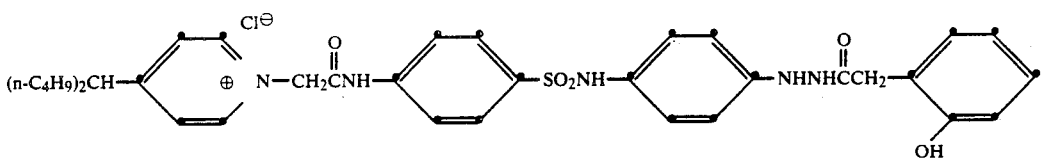

I-13

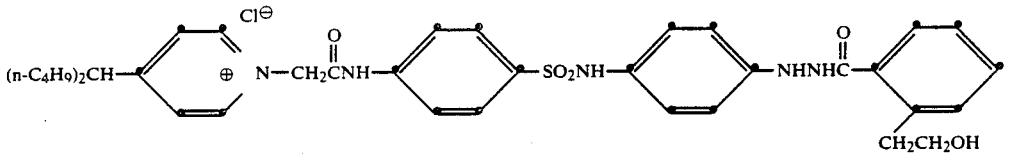

I-14

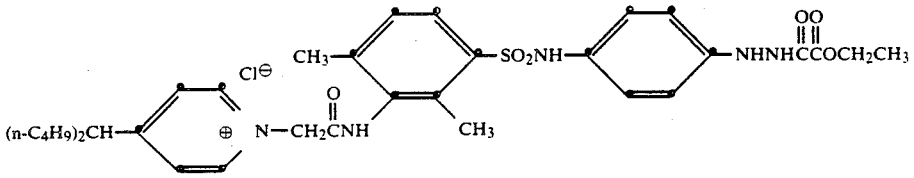

I-15

While certain preferred hydrazine compounds that are useful in this invention have been specifically described hereinabove, it is intended to include within the scope of this invention all hydrazine compound "nucleators" known to the art. Many such nucleators are described in "Development Nucleation By Hydrazine And Hydrazine Derivatives", Research Disclosure, Item 23510, Vol. 235, Nov. 10, 1983 and in numerous patents including U.S. Pat. Nos. 4,166,742; 4,168,977; 4,221.857; 4,224,401; 4,237,214; 4,241,164; 4,243,739; 4,269,929; 4,272,606; 4,272,614; 4,311,781; 4,332,878; 4,358,530; 4,377,634; 4,385,108; 4,429,036; 4,447,522; 4,540.655; 4,560,638; 4,569,904; 4,618,572; 4,619,886; 4,634.661; 4,650,746; 4,681,836; 4,686,167; 4,699,873; 4,722,884; 4,725,532; 4,737,442; 4,740,452; 4,912,016; and 4,914,003.

The hydrazide compounds are employed in combination with negative-working photographic emulsions comprised of radiation-sensitive silver halide grains capable of forming a surface latent image and a binder. The silver halide emulsions include high chloride emulsions conventionally employed in forming lithographic photographic elements, as well as silver bromide and silver bromoiodide emulsions which are recognized in the art as being capable of attaining higher photographic speeds. Generally, the iodide content of the silver halide emulsions is less than about 10 mole percent silver iodide, based on total silver halide.

Silver halide grains suitable for use in the emulsions of this invention are capable of forming a surface latent image, as opposed to being of the internal latent image-forming type. Surface latent image silver halide grains are employed in the majority of negative-working silver halide emulsions, whereas internal latent image-forming silver halide grains, while capable of forming a negative image when developed in an internal developer, are usually employed with surface developers to form direct-positive images. The distinction between surface latent image and internal latent image silver halide grains is generally well recognized in the art.

The silver halide grains, when the emulsions are used for lith applications, have a mean grain size of not larger than about 0.7 micron, preferably about 0.4 micron or less. Mean grain size is well understood by those skilled in the art, and is illustrated by Mees and James, *The Theory of the Photographic Process*, 3rd Ed., MacMillan 1966, Chapter 1, pp. 36–43. The photographic emulsions can be coated to provide emulsion layers in the photographic elements of any conventional silver coverage. Conventional silver coverages fall within the range of from about 0.5 to about 10 grams per square meter.

As is generally recognized in the art, higher contrasts can be achieved by employing relatively monodispersed emulsions. Monodispersed emulsions are characterized by a large proportion of the silver halide grains falling within a relatively narrow size-frequency distribution. In quantitative terms, monodispersed emulsions have been defined as those in which 90 percent by weight or by number of the silver halide grains are within plus or minus 40 percent of the mean grain size.

Silver halide emulsions contain, in addition to silver halide grains, a binder. The proportion of binder can be widely varied, but typically is within the range of from about 20 to 250 grams per mol of silver halide. Excessive binder can have the effect of reducing maximum densities and consequently also reducing contrast. For contrast values of 10 or more it is preferred that the binder be present in a concentration of 250 grams per mol of silver halide, or less.

The binders of the emulsions can be comprised of hydrophilic colloids. Suitable hydrophilic materials include both naturally occurring substances such as proteins, protein derivatives, cellulose derivatives, e.g., cellulose esters, gelatin, e.g., alkali-treated gelatin (pigskin gelatin), gelatin derivatives, e.g., acetylated gelatin, phthalated gelatin and the like, polysaccharides such as dextran, gum arabic, zein, casein, pectin, collagen derivatives, collodion, agar-agar, arrowroot, albumin and the like.

In addition to hydrophilic colloids the emulsion binder can be optionally comprised of synthetic polymeric materials which are water insoluble or only slightly soluble, such as polymeric latices. These materials can act as supplemental grain peptizers and carriers, and they can also advantageously impart increased dimensional stability to the photographic elements. The synthetic polymeric materials can be present in a weight ratio with the hydrophilic colloids of up to 2:1. It is generally preferred that the synthetic polymeric materials constitute from about 20 to 80 percent by weight of the binder.

Suitable synthetic polymer materials can be chosen from among poly(vinyl lactams), acrylamide polymers, polyvinyl alcohol and its derivative, polyvinyl acetals, polymers of alkyl and sulfoalkyl acrylates and methacrylates, hydrolyzed polyvinyl acetates, polyamides, polyvinyl pyridines, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, vinyl sulfide copolymers, halogenated styrene polymers, amineacrylamide polymers, polypeptides and the like.

Although the term "binder" is employed in describing the continuous phase of the silver halide emulsions, it is recognized that other terms commonly employed by those skilled in the art, such as carrier or vehicle, can be interchangeably employed. The binders described in connection with the emulsions are also useful in forming undercoating layers, interlayers and overcoating layers of the photographic elements of the invention. Typically the binders are hardened with one or more hardeners, such as those described in Paragraph VII, Product Licensing Index, Vol. 92, December 1971, Item 9232, which disclosure is hereby incorporated by reference.

Emulsions according to this invention having silver halide grains of any conventional geometric form (e.g. regular cubic or octahedral crystalline form) can be prepared by a variety of techniques, e.g., single-jet, double-jet (including continuous removal techniques), accelerated flow rate and interrupted precipitation techniques, as illustrated by Trivelli and Smith, *The Photographic Journal*, Vol. LXXIX, May, 1939, pp. 330–338, T. H. James, *The Theory of the Photographic Process*, 4th Ed., MacMillan, 1977, Chapter 3; Terwilliger et al Research Disclosure, Vol. 149, September 1976, Item 14987, as well as U.S. Pat. Nos. 2,222,264; 3,650,757; 3,672,900; 3,917,485; 3,790,387; 3,761,276; and 3,979,213, and German OLS No. 2,107,118 and U.K. Patent Publications 335,925; 1,430,465 and 1,469,480, which publications are incorporated herein by reference.

Double jet accelerated flow rate precipitation techniques are preferred for forming monodispersed emulsions. Sensitizing compounds, such as compounds of copper, thallium, cadmium, rhodium, tungsten, thorium, iridium and mixtures thereof, can be present during precipitation of the silver halide emulsion, as illustrated by U.S. Pat. Nos. 1,195,432; 1,951,933; 2,628,167; 2,950,972; 3,488,709; and 3,737,313, all incorporated herein by reference.

The individual reactants can be added to the reaction vessel through surface or sub-surface delivery tubes by gravity feed or by delivery apparatus for maintaining control of the pH and/or pAg of the reaction vessel contents, as illustrated by U.S. Pat. Nos. 3,821,002 and 3,031,304 and Claes et al, Photographische Korrespondenz, 102 Band, Number 10, 1967, p. 162. In order to obtain rapid distribution of the reactants within the reaction vessel, specially constructed mixing devices can be employed as illustrated by U.S. Pat. Nos. 2,996,287; 3,342,605; 3,415,650; and 3,785,777; and German OLS Nos. 2,556,885 and 2,555,364. An enclosed reaction vessel can be employed to receive and to mix reactants upstream of the main reaction vessel, as illustrated by U.S. Pat. Nos. 3,897,935 and 3,790,386.

The grain size distribution of the silver halide emulsions can be controlled by silver halide grain separation techniques or by blending silver halide emulsions of differing grain sizes. The emulsions can include ammonical emulsions, as illustrated by Glafkides, *Photographic Chemistry*, Vol. 1, Fountain Press, London, 1958, pp. 365–368 and 301–304; thiocyanate ripened emulsions, as illustrated by U.S. Pat. No. 3,320,069; thioether ripened emulsions, as illustrated by U.S. Pat. Nos. 3,271,157; 3,574,628 and 3,737,313 or emulsions containing weak silver halide solvents, such as ammonium salts, as illustrated by U.S. Pat. No. 3,784,381 and *Research Disclosure*, Vol. 134, June 1975, Item 13452.

The silver halide emulsion can be unwashed or washed to remove soluble salts. The soluble salts can be removed by chill setting and leaching, as illustrated by U.S. Pat. Nos. 2,316,845 and 3,396,027; by coagulation washing, as illustrated by U.S. Pat. Nos. 2,618,556; 2,614,928; 2,565,418; 3,241,969; and 2,489,341 and by U.K. Patent Nos. 1,035,409 and 1,167,159; by centrifugation and decantation of a coagulated emulsion, as illustrated by U.S. Pat. Nos. 2,463,794; 3,707,378; 2,996,287; and 3,498,454; by employing hydrocyclones alone or in combination with centrifuges, as illustrated by U.K. Patent Nos. 336,692 and 1,356,573; by diafiltration with a semipermeable membrane, as illustrated by *Research Disclosure*, Vol. 102, October 1972, Item 10208. The emulsions, with or without sensitizers, can be dried and stored prior to use as illustrated by *Research Disclosure*, Vol. 101, September 1972, Item 10152.

The silver halide emulsions can be chemically sensitized with active gelatin, as illustrated by T. H. James, *The Theory of the Photographic Process*, 4th Ed., MacMillan, 1977, pp. 67–76, or with sulfur, selenium, tellurium, platinum, palladium, iridium, osmium, rhenium or phosphorus sensitizers or combinations of these sensitizers, such as at pAg levels of from 5 to 10, pH levels of from 5 to 8 and temperatures of from 30° to 80° C., as illustrated by *Research Disclosure*, Vol. 134, June 1975, Item 13452. The emulsions need not be chemically sensitized, however, in order to exhibit the advantages of this invention.

The silver halide emulsions can be spectrally sensitized with dyes from a variety of classes, including the polymethine dye class, which includes the cyanines, merocyanines, complex cyanines and merocyanines (i.e., tri-, tetra- and polynuclear cyanines and merocyanines), oxonols, hemioxonols, styryls, merostyryls and streptocyanines.

By suitable choice of substituent groups the dyes can be cationic, anionic or nonionic. Preferred dyes are cationic cyanine and merocyanine dyes. Emulsions containing cyanine and merocyanine dyes have been observed to exhibit relatively high contrasts. Spectral sensitizing dyes specifically preferred for use in the practice of this invention are as follows:

SS-1: Anhydro-5,5'-dichloro-9-ethyl-3,3'-bis(3-sulfopropyl)oxacarbocyanine hydroxide, sodium salt SS-2: 5,5',6,6'-Tetrachloro-1,1',3,3'-tetraethylbenzimidazolocarbocyanine iodide SS-3: 3,3'-Diethyl-9-methylthiacarbocyanine bromide SS-4: 3,3'-Diethyloxacarbocyanine iodide SS-5: 5,5'-Dichloro-3,3',9-triethylthiacarbocyanine bromide SS-6: 3,3'-Diethylthiocarbocyanine iodide SS-7: 5,5'-Dichloro-2,2'-diethylthiocarbocyanine, p-toluene sulfonate salt SS-8: 3-Carboxymethyl-5-[(3-methyl-2-thiazolidinylidene)-1-methylethylidene]rhodanine SS-9: 3-Ethyl-3-[3-ethyl-2-thiazolidinylidene)-1-methylethylidene]rhodanine SS-10: 5-[(3-(2-Carboxyethyl)-2-thiazolidinylidene)ethylidene]-3-ethylrhodanine SS-11: 1-Carboxymethyl-5-[(3-ethyl-2-benzothiazolinylidene)ethylidene]-3-phenyl-2-thiohydantoin SS-12: 1-Carboxymethyl-5-[(1-ethyl-2(H)-naphtho[1,2-d]thiazolin-2-ylidene)ethylidene]-3-phenyl-2-thiohydantoin SS-13: 3-Carboxymethyl-5-[(3-ethyl-2-benzothiazolinylidene)ethylidene]rhodanine SS-14: 5-[3-Ethyl-2-benzoxazolinylidene)ethylidene]-3-heptyl-2-thio-2,4-oxazolidinedione SS-15: 3-Carboxymethyl-5-(3-ethyl-2-benzothiazolinylidene)rhodanine SS-16: 3-Carboxymethyl-5-(3-methyl-2-benzoxazolinylidene)rhodanine SS-17: 3-Ethyl-5-[3-ethyl-2-benzoxazolinylidene)ethylidene]rhodanine.

The photographic elements can be protected against fog by incorporation of antifoggants and stabilizers in the element itself or in the developer in which the element is to be processed. Illustrative of conventional antifoggants and stabilizers useful for this purpose are those disclosed by Paragraph V, *Product Licensing Index*, Vol. 92, December 1971, Item 9232, which publication is hereby incorporated by reference.

It has been observed that both fog reduction and an increase in contrast can be obtained by employing benzotriazole antifoggants either in the photographic element or the developer in which the element is processed. The benzotriazole can be located in the emulsion layer or in any other hydrophilic colloid layer of the photographic element in a concentration in the range of from about $10^{-4}$ to $10^{-1}$, preferably $10^{-3}$ to $3\times10^{-2}$, mol per mol of silver. When the benzotriazole antifoggant is added to the developer, it is empolyed in a concentration of from $10^{-6}$ to about $10^{-1}$, preferably $3\times10^{-5}$ to $3\times10^{-2}$, mol per liter of developer.

Useful benzotriazoles can be chosen from among conventional benzotriazole antifoggants. These include benzotriazole (that is, the unsubstituted benzotriazole compound), halo-substituted benzotriazoles (e.g., 5-chlorobenzotriazole, 4-bromobenzotriazole and 4-chlorobenzotriazole) and alkyl-substituted benzotriazoles wherein the alkyl moiety contains from 1 to about 12 carbon atoms (e.g., 5-methylbenzotriazole).

In addition to the components of the photographic emulsions and other hydrophilic colloid layers described above it is appreciated that other conventional element addenda compatible with obtaining relatively high contrast images can be present. For example, addenda can be present in the described photographic elements and emulsions in order to stabilize sensitivity. Preferred addenda of this type include carboxyalkyl substituted 3H-thiazoline-2-thione compounds of the type described in U.S. Pat. No. 4,634,661. Also, the photographic elements can contain developing agents (described below in connection with the processing steps), development modifiers, plasticizers and lubricants, coating aids, antistatic materials, matting agents, brighteners and color materials, these conventional materials being illustrated in Paragraphs IV, VI, IX, XII, XIII, XIV and XXII of *Product Licensing Index*, Vol. 92, December 1971, Item 9232, incorporated herein by reference.

The hydrazide compounds, sensitizing dyes and other addenda incorporated into layers of the photographic elements can be dissolved and added prior to coating either from water or organic solvent solutions, depending upon the solubility of the addenda. Ultrasound can be employed to dissolve addenda. Semipermeable and ion exchange membranes can be used to introduce addenda, such as water soluble ions (e.g. chemical sensitizers). Hydrophobic addenda, particularly those which need not be adsorbed to the silver halide grain surfaces to be effective, such as couplers, redox dye-releasers and the like, can be mechanically dispersed directly or in high boiling (coupler) solvents, as illustrated in U.S. Pat. Nos. 2,322,027 and 2,801,171, or the hydrophobic addenda can be loaded into latices and dispersed, as illustrated by *Research Disclosure*, Vol. 159, July 1977, Item 15930.

In forming photographic elements the layers can be coated on photographic supports by various procedures, including immersion or dip coating, roller coating, reverse roll coating, doctor blade coating, gravure coating, spray coating, extrusion coating, bead coating, stretch-flow coating and curtain coating. High speed coating using a pressure differential is illustrated by U.S. Pat. No. 2,681,294.

The layers of the photographic elements can be coated on a variety of supports. Typical photographic supports include polymeric film, wood fiber, e.g., paper, metallic sheet or foil, glass and ceramic supporting elements provided with one or more subbing layers to enhance the adhesive, antistatic, dimensional, abrasive, hardness, frictional, antihalation and/or other properties of the support surface.

Typical of useful polymeric film supports are films of cellulose nitrate and cellulose esters such as cellulose triacetate and diacetate, polystyrene, polyamines, homo- and co-polymers of vinyl chloride, poly(vinyl acetal), polycarbonate, homo- and copolymers of olefins, such as polyethylene and polypropylene, and polyesters of dibasic aromatic carboxylic acids with divalent alcohols, such as poly(ethylene terephthalate).

Typical of useful paper supports are those which are partially acetylated or coated with baryta and/or a polyolefin, particularly a polymer of an α-olefin containing 2 to 10 carbon atoms, such as polyethylene, polypropylene, copolymers of ethylene and propylene and the like.

Polyolefins, such as polyethylene, polypropylene and polyallomers, e.g., copolymers of ethylene with propylene, as illustrated by U.S. Pat. No. 4,478,128, are preferably employed as resin coatings over paper, as illustrated by U.S. Pat. Nos. 3,411,908 and 3,630,740, over polystyrene and polyester film supports, as illustrated by U.S. Pat. No. 3,630,742, or can be employed as unitary flexible reflection supports, as illustrated by U.S. Pat. No. 3,973,963.

Preferred cellulose ester supports are cellulose triacetate supports, as illustrated by U.S. Pat. Nos. 2,492,977; 2,492.978 and 2,739,069, as well as mixed cellulose ester supports, such as cellulose acetate propionate and cellulose acetate butyrate, as illustrated by U.S. Pat. No. 2,739.070.

Preferred polyester film supports are comprised of linear polyester, such as illustrated by U.S. Pat. Nos. 2,627,088; 2,720,503; 2,779,684 and 2,901,466.

The photographic elements can be imagewise exposed with various forms of energy, which encompass the ultraviolet and visible (e.g., actinic) and infrared regions of the electromagnetic spectrum as well as electron beam and beta radiation, gamma ray, X-ray, alpha particle, neutron radiation and other forms of corpuscular and wavelike radiant energy in either noncoherent (random phase) forms or coherent (in phase) forms, as produced by lasers. Exposures can be monochromatic, orthochromatic or panchromatic. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process*, 4th Ed., MacMillan, 1977, Chapters 4, 6, 17 18 and 23.

The light-sensitive silver halide contained in the photographic elements can be processed following exposure to form a visible image by associating the silver halide with an aqueous alkaline medium in the presence of a developing agent contained in the medium or the element. It is a distinct advantage of the present invention that the described photographic elements can be processed in conventional developers as opposed to specialized developers conventionally employed in conjunction with lithographic photographic elements to obtain very high contrast images. When the photographic elements contain incorporated developing agents, the elements can be processed in the presence of an activator, which can be identical to the developer in composition, but otherwise lacking a developing agent. Very high contrast images can be obtained at pH values in the range of from 11 to 12.3, but preferably lower pH values, for example below 11 and most preferably in the range of about 9 to about 10.8 are preferably employed with the photographic recording materials as described herein.

The developers are typically aqueous solutions, although organic solvents, such as diethylene glycol, can also be included to facilitate the solvency of organic components. The developers contain one or a combination of conventional developing agents, such as a polyhydroxybenzene, aminophenol, para-phenylenediamine, ascorbic acid, pyrazolidone, pyrazolone, pyrimidine, dithionite, hydroxylamine or other conventional developing agents. It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulfate can be incorporated into the developer. Also, compounds such as sodium thiocyanate can be present to reduce granularity. Chelating and sequestering agents, such as ethylenediaminetetraacetic acid or its sodium salt, can be present. Generally, any conventional developer composition can be employed in the practice of this invention. Specific illustrative photographic developers are disclosed in the Handbook of Chemistry and Physics, 36th Edition, under the title "Photographic Formulae" at page 3001 et seq. and in Processing Chemicals and Formulas, 6th Edition, published by Eastman Kodak Company (1963), the disclosures of which are here incorporated by reference. The photographic elements can, of course, be processed with conventional developers for lithographic photographic elements, as illustrated by U.S. Pat. No. 3,573,914 and U.K. Patent No. 376,600.

*Product Licensing Index* and *Research Disclosure* are published by Kenneth Mason Publications, Ltd., The Old Harbourmaster's, 8 North Street, Emsworth, Hampshire P010 7DD, ENGLAND.

It is preferred that the novel photographic elements of this invention are processed in developing compositions containing a dihydroxybenzene developing agent. It is more preferred that they are processed in a developing composition containing an auxiliary super-additive developing agent in addition to the dihydroxybenzene which functions as the primary developing agent. It is especially preferred that the auxiliary super-additive developing agent be a 3-pyrazolidone.

The dihydroxybenzene developing agents employed in the method of this invention are well known and widely used in photographic processing. The preferred developing agent of this class is hydroquinone. Other useful dihydroxybenzene developing agents include:

chlorohydroquinone,
bromohydroquinone,
isopropylhydroquinone,
toluhydroquinone,
methylhydroquinone,
2,3-dichlorohydroquinone,
2,5-dimethylhydroquinone,
2,3-dibromohydroquinone,
1,4-dihydroxy-2-acetophenone-2,5-dimethylhydroquinone,
2,5-diethylhydroquinone,
2,5-di-p-phenethylhydroquinone,
2,5-dibenzoylaminohydroquinone,
2,5-diacetaminohydroquinone,
and the like.

The auxiliary super-additive developing agents employed in the aqueous alkaline developing solutions are also well known and widely used in photographic processing. As explained in Mason, "Photographic Processing Chemistry", Focal Press, London, 1975, "superadditivity" refers to a synergistic effect whereby the combined activity of a mixture of two developing agents is greater than the sum of the two activities when each agent is used alone in the same developing solution (Note especially the paragraph entitled, "Superadditivity" on Page 29 of Mason).

For the purposes of this invention, the preferred auxiliary super-additive developing agents are the 3-pyrazolidone developing agents. Particularly preferred developing agents of this class are those represented by the formula:

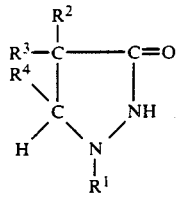

in which $R^1$ is aryl (including substituted aryl) and $R^2$, $R^3$, and $R^4$ are hydrogen or alkyl (including substituted alkyl). Included within the definition of $R^1$ are phenyl and phenyl substituted with groups such as methyl, chloro, amino, methylamino, acetylamino, methoxy and methylsulfonamidoethyl. Included within the definition of $R^2$, $R^3$ and $R^4$ are unsubstituted alkyl and alkyl substituted with groups such as hydroxy, carboxy, or sulfo. The most commonly used developing agents of this class are 1-phenyl-3-pyrazolidone, 1-phenyl-4,4-dimethyl-3-pyrazolidone, 1-phenyl-4-methyl-4-hydroxymethyl-3-pyrazolidone and 1-phenyl-4,4-dihydroxymethyl-3-pyrazolidone. Other useful 3-pyrazolidone developing agents include:

1-phenyl-5-methyl-3-pyrazolidone,
1-phenyl-4,4-diethyl-3-pyrazolidone,
1-p-aminophenyl-4-methyl-4-propyl-3-pyrazolidone,
1-p-chlorophenyl-4-methyl-4-ethyl-3-pyrazolidone,
1-p-acetamidophenyl-4,4-diethyl-3-pyrazolidone,
1-p-betahydroxyethylphenyl-4,4-dimethyl-3-pyrazolidone,
1-p-hydroxyphenyl-4,4-dimethyl-3-pyrazolidone,
1-p-methoxyphenyl-4,4-diethyl-3-pyrazolidone,
1-p-tolyl-4,4-dimethyl-3-pyrazolidone,
and the like.

Less preferred but also useful auxiliary super-additive developing agents for use in the method of this invention are the aminophenols. Examples of useful aminophenols include:

p-aminophenol
o-aminophenol
p-methylaminophenol sulfate
2,4-diaminophenol hydrochloride
N-(4-hydroxyphenyl)glycine
p-benzylaminophenol hydrochloride
2,4-diamino-6-methylphenol
2,4-diaminoresorcinol
N-(beta-hydroxyethyl)-p-aminophenol
and the like.

More than one auxiliary super-additive developing agent can be incorporated in the developing solution if desired. For example, the developing solution can contain hydroquinone, 1-phenyl-3-pyrazolidone, and p-methylaminophenol sulfate. More than one dihydroxybenzene developing agent can, of course, also be utilized, if desired.

Suitable buffering agents, such as borates, carbonates and phosphates can be included in the developing solution to provide adequate buffering capacity.

The aqueous alkaline photographic developing compositions employed herein preferably contain a sulfite preservative at a level sufficient to protect the developing agents against aerial oxidation and thereby promote good stability characteristics. Useful sulfite preservatives include sulfites, bisulfites, metabisulfites, and carbonyl bisulfite adducts. Typical examples of sulfite preservatives include:

sodium sulfite,
potassium sulfite,
lithium sulfite,
ammonium sulfite,
sodium bisulfite,
potassium metabisulfite,
sodium formaldehyde bisulfite,
and the like.

Other anti-oxidants such as hydroxylamine and ascorbic acid can be used instead of or in combination with the sulfites.

The aqueous alkaline developing solutions can vary widely in regard to the concentration of the various ingredients included therein. Typically, the dihydroxybenzene developing agent is used in an amount of from about 0.045 to about 0.65 moles per liter, more preferably in an amount of about 0.09 to about 0.36 moles per liter; the auxiliary super-additive developing agent is used in an amount of from about 0.0005 to about 0.01 moles per liter, more preferably in an amount of from about 0.001 to about 0.005 moles per liter; and the sulfite preservative is used in an amount of from about 0.04 to about 0.80 moles per liter, more preferably in an amount of from about 0.12 to about 0.60 moles per liter.

The photographic system to which this invention pertains is one which employs a hydrazine compound as a nucleating agent and an amino compound as an "incorporated booster". Amino compounds which are particularly effective as "incorporated boosters" are described in copending commonly assigned U.S. patent application Ser. No. 359,009, "Photographic Element And Process Adapted To Provide High Contrast Development", by H. I. Machonkin and D. L. Kerr, filed May 30, 1989 as a continuation-in-part of application Ser. No. 255,881, filed Oct. 11, 1988 issued Dec. 4, 1990 as U.S. Pat. No. 4,975,354.

The amino compounds useful as "incorporated boosters" described in the aforesaid application Ser. No. 359,009 are amino compounds which:

(1) comprise at least one secondary or tertiary amino group;

(2) contain within their structure a group comprised of at least three repeating ethyleneoxy units, and (3) have a partition coefficient, as hereinafter defined, of at least one, preferably at least three, and most preferably at least four.

Included within the scope of the amino compounds utilized in this invention as "incorporated boosters" are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amino compounds employed in this invention as "incorporated boosters" are compounds of at least 20 carbon atoms.

Preferred amino compounds for use as "incorporated boosters" are bis-tertiary-amines which have a partition coefficient of at least three and a structure represented by the formula:

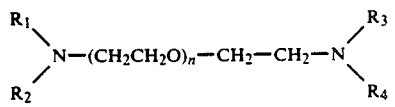

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another advantageous group of amino compounds for use as "incorporated boosters" are bis-secondary amines which have a partition coefficient of at least three and a structure represented by the formula:

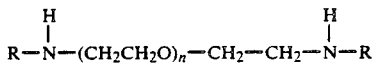

wherein n is an integer with a value of 3 to 50, and more preferably 10 to 50, and each R is, independently, a linear or branched, substituted or unsubstituted, alkyl group of at least 4 carbon atoms.

Preferably the group comprised of at least three repeating ethyleneoxy units is directly linked to a tertiary amino nitrogen atom and most preferably the group comprised of at least three repeating ethyleneoxy units is a linking group joining tertiary amino nitrogen atoms of a bis-tertiary-amino compound.

The amino compound utilized as an "incorporated booster" is typically employed in an amount of from about 1 to about 25 millimoles per mole of silver, and more preferably in an amount of from about 5 to about 15 millimoles per mole of silver.

Representative examples of amino compounds suitable for use as "incorporated boosters" in accordance with this invention include the following:

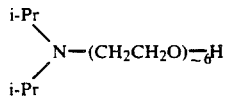

I.

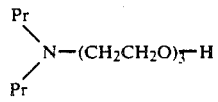

II.

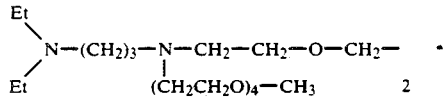

III.

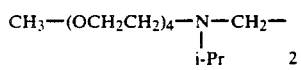

IV.

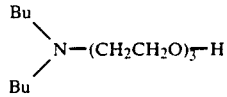

V.

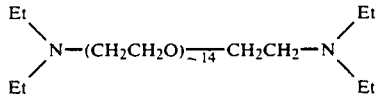

VI.

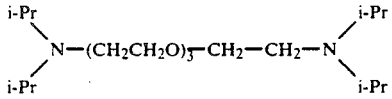

VII.

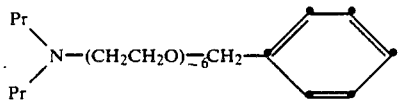

VIII.

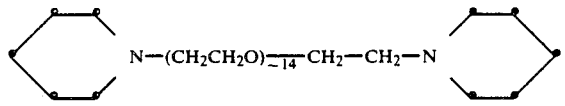

IX.

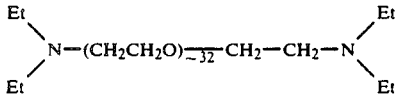

X.

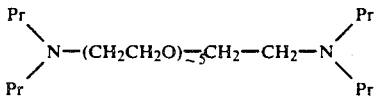

XI.

-continued

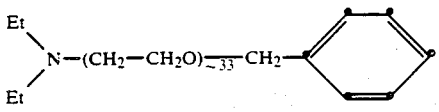

XII.

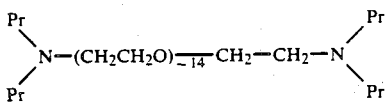

XIII.

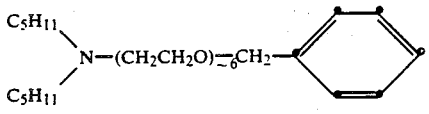

XIV.

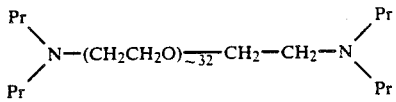

XV.

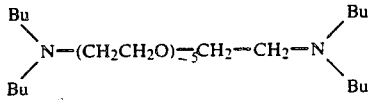

XVI.

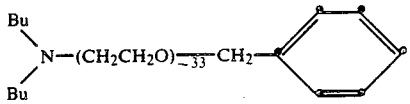

XVII.

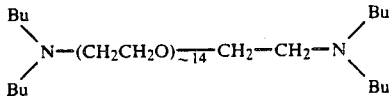

XVIII.

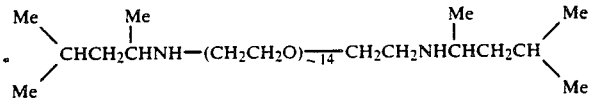

XIX.

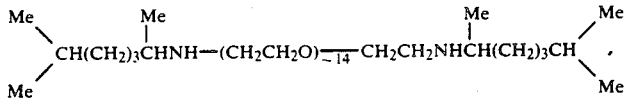

XX.

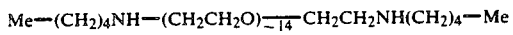

XXI.

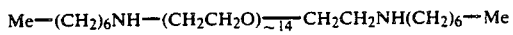

XXII.

In the above formulae, "Me" represents methyl, "Et" represents ethyl, "Pr" represents propyl, "i—Pr" represents isopropyl and "Bu" represents butyl.

Other amino compounds useful as "incorporated boosters" are described in Yagihara et al, U.S. Pat. No. 4,914,003 issued Apr. 3, 1990. The amino compounds described in this patent are represented by the formula:

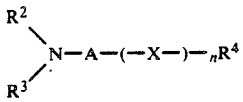

wherein $R^2$ and $R^3$ each represent a substituted or unsubstituted alkyl group or may be linked to each other to form a ring; $R^4$ represents a substituted or unsubstituted alkyl, aryl or heterocyclic group; A represents a divalent linkage; X represents $—CONR^5—$, —O—, $CONR^5$, $—NR^5CONR^5—$, $—NR^5COO—$, —COO—, —OCO—, —CO—, $—NR^5CO—$, $—SO_2NR^5—$, $—NR^5SO_2—$, $—SO_2—$, —S— or —O— group in which $R^5$ represents a hydrogen atom or a lower alkyl group and n represents 0 or 1, with the proviso that the total number of carbon atoms contained in $R^2$, $R^3$, $R^4$ and A is 20 or more.

As hereinabove described, the present invention is based on the discovery that ballasted hydrophobic isothiourea compounds having a partition coefficient of at least one and preferably at least three are effective in inhibiting pepper fog and restraining image spread in a high contrast photographic system that employs a hydrazine compound as a nucleating agent and an amino compound as an "incorporated booster". As also described hereinabove, the preferred ballasted hydrophobic isothiourea compounds for use in this invention are of the formula:

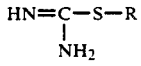

wherein R is a ballasting group that contains at least six carbon atoms, and is substantially free of solubilizing groups.

The ballasting group defined by R is an organic radical of such size and configuration as to confer on the isothiourea compound sufficient bulk to render it substantially non-diffusible from the layer in which it is coated in a photographic element.

Any of a very wide variety of ballasting groups that are effective to retain the isothiourea compound in the photographic element during development can be attached to the sulfur atom. The isothiourea compound can be employed as the free base or as a suitable salt such as the hydrochloride or hydrobromide salt.

The ballasting group R preferably contains at least six carbon atoms and more preferably at least twelve carbon atoms. Examples of useful ballasting groups include those comprised of one or more of alkyl, cycloalkyl, heterocyclic, aryl, aralkyl, alkaryl, alkoxy, alkoxycarbonyl, alkoxyalkyl, aryloxy, dialkylaminoalkyl, alkylcarbonamido and alkylsulfonamido moieties.

Particularly preferred classes of isothioureas for the purpose of this invention are compounds represented by one of formulae I to III below:

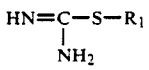

I.

where $R_1$ is an alkyl group of 8 to 30 carbon atoms.

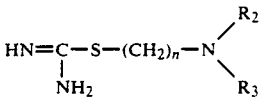

II.

where n is 2 to 6 and $R_2$ and $R_3$ are alkyl groups of 2 to 6 carbon atoms.

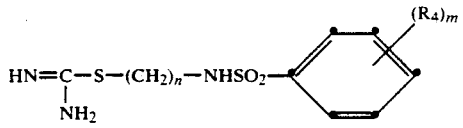

III.

where n is 2 to 6, m is 1 to 3 and $R_4$ is alkyl of 1 to 6 carbon atoms.

Another preferred group of isothiourea compounds for the purposes of this invention are bis-isothiourea compounds represented by the formula:

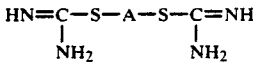

IV.

wherein A is a divalent linking group such as an alkylene group. Preferably A is alkylene of at least six carbon atoms and more preferably at least ten carbon atoms. Generally speaking, the bis-isothiourea compounds are effective in lower concentrations than compounds having a single isothiourea group.

The ballasted hydrophobic isothiourea compound is typically utilized in this invention in an amount of from about 0.1 to about 10 millimoles per mole of silver and more preferably in an amount of from about 0.5 to about 2 millimoles per mole of silver.

While applicants do not wish to be bound by any theoretical explanation for the manner in which their invention functions, it is beleived that the isothiourea compound releases a free mercaptan in the photographic element during development and that the mercaptan binds to the silver. Isothiourea compounds are pH sensitive, and the rate at which the mercaptan is released increases with increasing pH of the developing solution. Use of either too high a pH or too great a concentration of the isothiourea compound is undesirable. While it will inhibit pepper fog, there will be an accompanying undesirable decrease in speed and/or upper scale contrast.

Typical specific examples of ballasted hydrophobic isothioureas useful in this invention include the following:

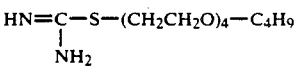

(1)

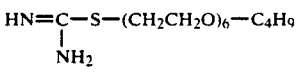

(2)

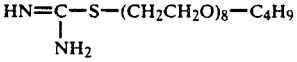

(3)

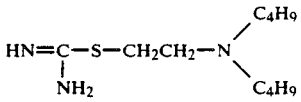

(4)

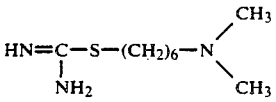

(5)

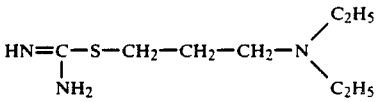

(6)

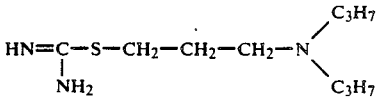

(7)

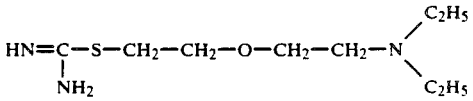

(8)

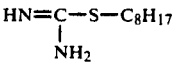

(9)

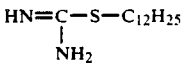

(10)

-continued
(11)
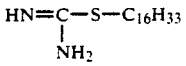
(12)
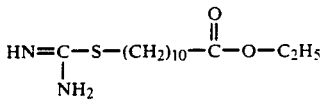
(13)
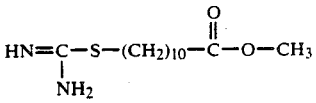
(14)
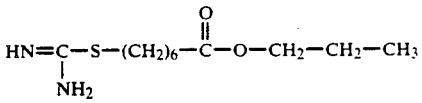
(15)
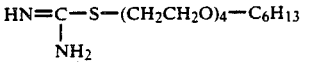
(16)
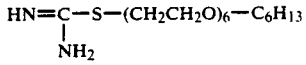
(17)
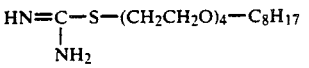
(18)
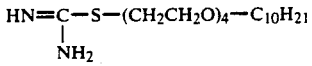
(19)
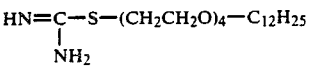
(20)
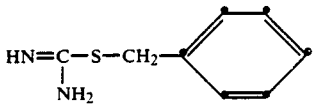
(21)
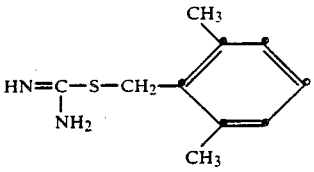
(22)
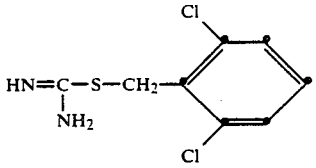
(23)
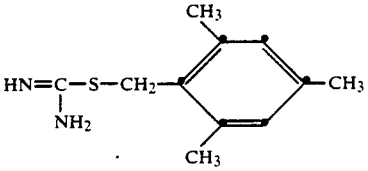
(24)
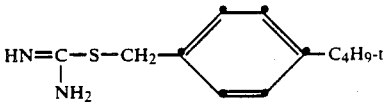
(25)
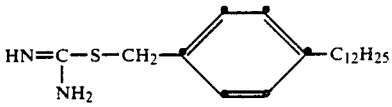
(26)
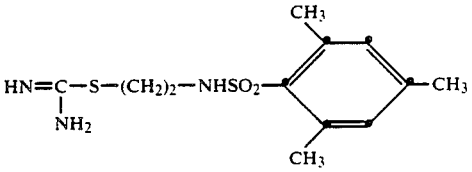
(27)
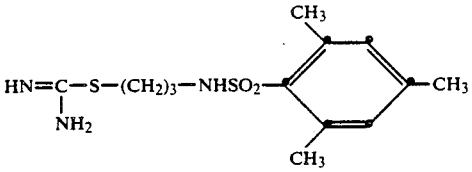
(28)
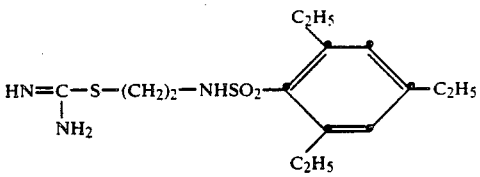
(29)
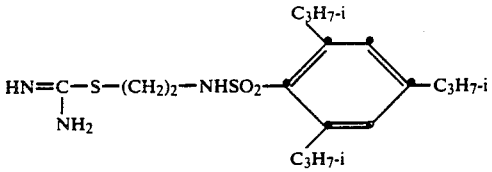
(30)
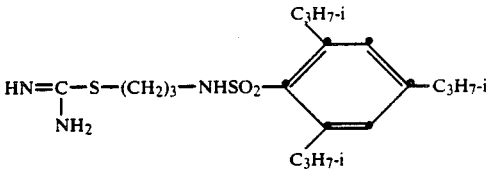
(31)
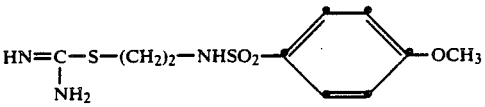
(32)
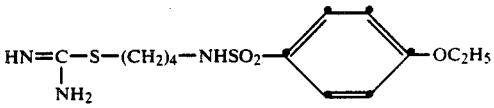
(33)
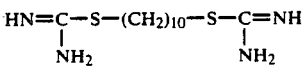
(34)
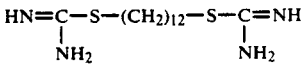

-continued
(35)
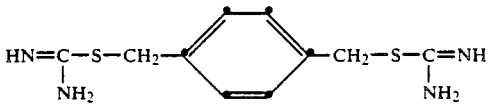
(36)
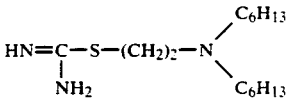
(37)
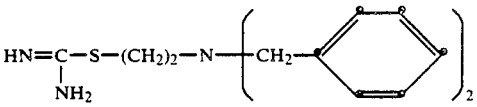
(38)
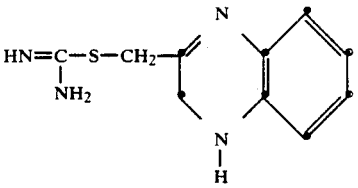
(39)
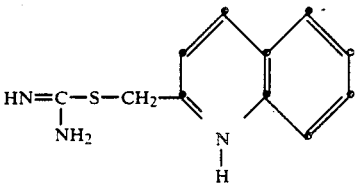
(40)
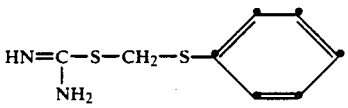
(41)
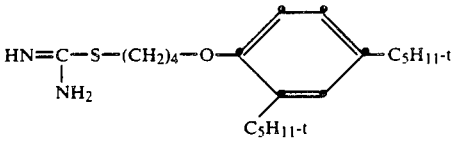
(42)
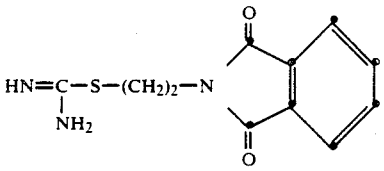
(43)
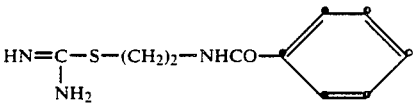
(44)
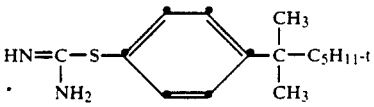
(45)
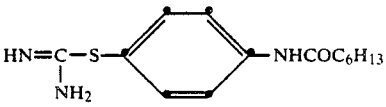
(46)
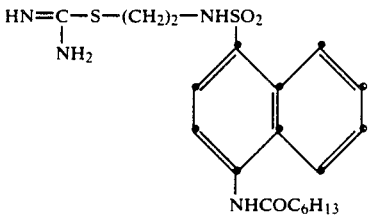
(47)
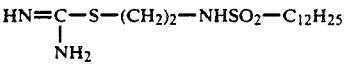
(48)
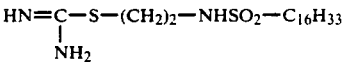
(49)
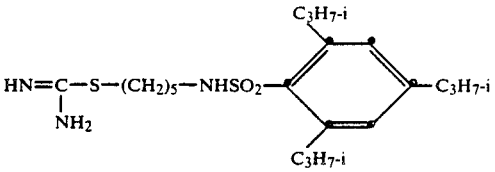
(50)
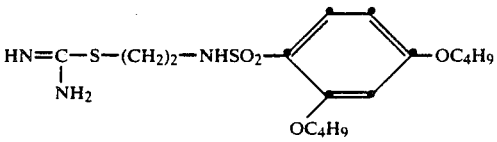
(51)
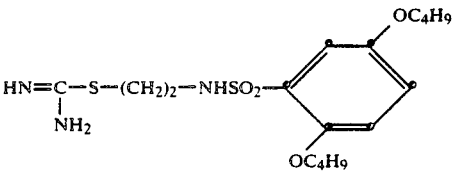

-continued

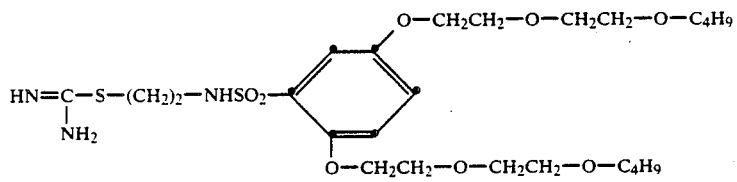

(52)

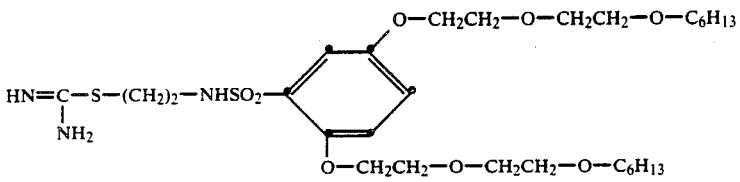

(53)

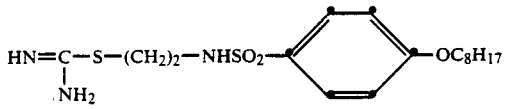

(54)

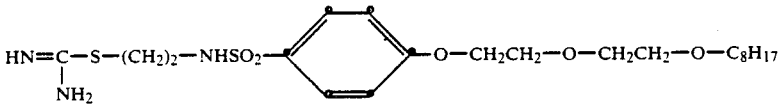

(55)

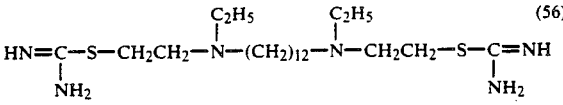

(56)

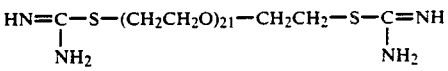

(57)

To be highly effective in this invention, the isothiourea compound must be sufficiently ballasted and sufficiently hydrophobic that no substantial degree of leaching into the developing solution occurs during development. Any strongly ionizing group will act as a solubilizing group and should, therefore, not be a part of the ballast. The seasoning effects resulting from leaching into the developing solution are highly undesirable, since they bring about unwanted variability in the development process.

The term "partition coefficient", as used herein, refers to the log P value of the compound with respect to the system n-octanol/water as defined by the equation:

$$\log P = \log \frac{[X]_{octanol}}{[X]_{water}}$$

where X=concentration of the compound. The partition coefficient is a measure of the ability of a compound to partition between aqueous and organic phases and is calculated in the manner described in an article by A. Leo, P. Y. C. Jow, C. Silipo and C. Hansch, Journal of Medicinal Chemistry, Vol. 18, No. 9, pp. 865–868, 1975. Calculations for log P can be carried out using MedChem software, version 3.54, Pomona College, Claremont, Calif. The higher the value of log P the more hydrophobic the compound. Compounds with a log P of greater than zero are hydrophobic, i.e., they are more soluble in organic media than in aqueous media, whereas compounds with a log P of less than zero are hydrophilic. A compound with a log P of one is ten times more soluble in organic media than in aqueous media and a compound with a log P of two is one hundred times more soluble in organic media than in aqueous media.

The invention is further illustrated by the following examples of its practice.

EXAMPLES 1-17

Each coating used in obtaining the data provided in these examples was prepared on a polyester support, using a monodispersed 0.24 μm AgBrI (2.5 mol % iodide) iridium-doped emulsion at 3.51 g/m$^2$ Ag, 2.54 g gel/m$^2$, and 1.08 g latex/m$^2$ where the latex is a copolymer of methyl acrylate, 2-acrylamido-2-methylpropane sulfonic acid, and 2-acetoacetoxyethylmethylacrylate. The silver halide emulsion was spectrally sensitized with 214 mg/Ag mol of anhydro-5,5'-dichloro-9-ethyl-3,3'-di-(3-sulfopropyl) oxacarbocyanine hydroxide, triethylene salt and the emulsion layer was overcoated with gelatin containing polymethylmethacrylate beads. The nucleating agent was added as a methanol solution to the emulsion melts at a level of 0.75 millimoles (mM) per mole of silver. The compound employed as the nucleating agent is represented by the formula:

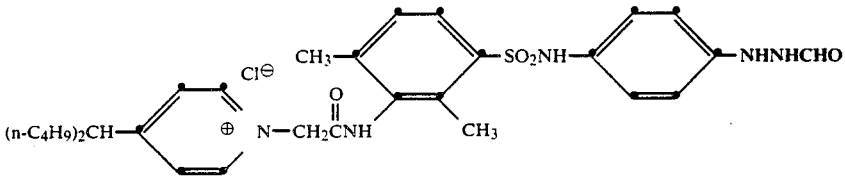

An "incorporated booster" was added as a methanol solution in an amount of 2 grams per mole of silver. The compound employed as the "incorporated booster" is represented by the formula:

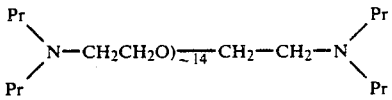

where Pr represents n-propyl.

Coatings were exposed for five seconds to a 3000° K. tungsten light source and processed for 1 minute at 35° C. in the developer solution.

To prepare the developer solution, a concentrate was prepared from the following ingredients:

Sodium metabisulfite: 145 g
45% Potassium hydroxide: 178 g
Diethylenetriamine pentaacetic acid pentasodium salt (40% solution): 15 g
Sodium bromide: 12 g
Hydroquinone: 65 g
1-Phenyl-4-hydroxymethyl-4-methyl-3-pyrazolidone: 2.9 g
Benzotriazole: 0.4 g
1-Phenyl-5-mercaptotetrazole: 0.05 g
50% Sodium hydroxide: 46 g
Boric acid: 6.9 g
Diethylene glycol: 120 g
47% Potassium Carbonate: 120 g
Water to one liter The concentrate was diluted at a ratio of one part of concentrate to two parts of water to produce a working strength developing solution with a pH of 10.5.

An electronic image analyzer was used to scan processed unexposed samples and count the number of pepper fog spots (>10 micrometer diameter) contained in an area of 600 square millimeters. Standard sensitometry exposures were processed and analyzed to monitor speed and shoulder density effects.

In each of examples 1, 6, 7 and 8, the isothiourea was employed in the form of the free base, in examples 3, 4, 5, 9, 10, 11, 12, 13, 14, 15, 16 and 17 in the form of the hydrobromide salt, and in example 2 in the form of the dihydrochloride salt. In comparative tests A to D, the isothiourea was employed in the form of the hydrobromide salt and in comparative tests E to H in the form of the free base.

Comparative examples A to H represent isothioureas outside the scope of the present invention.

Sensitometry parameters are expressed in Table I in terms of the change produced by incorporation of the isothiourea compound versus the control which contained no isothiourea compound and was processed under identical conditions. Values are reported for speed, practical density point (PDP) and pepper fog (PF). Therefore, the changes in speed, practical density point and pepper fog produced by the isothiourea compound are directly recorded in the table. By definition, the delta log speed, delta PDP and delta log PF for the control are zero.

TABLE I

| Example[1] No. | Isothiourea Compound | Concentration (millimoles per mole of silver) | Log P | Delta[2] Log Speed | Delta[3] PDP | Delta[4] Log PF |
|---|---|---|---|---|---|---|
| 1 | $HN{=}C(NH_2){-}S{-}(CH_2CH_2O)_4{-}C_4H_9$ | 1.0 | 1.66 | −0.01 | −0.11 | −0.17 |
| 2 | $HN{=}C(NH_2){-}S{-}CH_2CH_2{-}N(C_4H_9)_2$ | 1.0<br>0.4 | 2.98 | −0.11<br>−0.08 | −0.36<br>−0.29 | −2.04<br>−0.87 |
| 3 | $HN{=}C(NH_2){-}S{-}C_8H_{17}$ | 1.0 | 3.78 | 0.00 | +0.08 | −0.63 |
| 4 | $HN{=}C(NH_2){-}S{-}C_{12}H_{25}$ | 1.0<br>1.0<br>0.4 | 5.90 | −0.03<br>−0.08<br>−0.04 | +0.04<br>−0.34<br>−0.09 | −1.46<br>−1.16<br>−0.56 |
| 5 | $HN{=}C(NH_2){-}S{-}(CH_2)_{10}{-}COOC_2H_5$ | 1.0 | 4.29 | −0.05 | +0.33 | −0.79 |
| 6 | $HN{=}C(NH_2){-}S{-}(CH_2CH_2O)_4{-}C_6H_{13}$ | 1.0 | 2.72 | −0.05 | −0.24 | −0.41 |

TABLE I-continued
| Example[1] No. | Isothiourea Compound | Concentration (millimoles per mole of silver) | Log P | Delta[2] Log Speed | Delta[3] PDP | Delta[4] Log PF |
|---|---|---|---|---|---|---|
| 7 | $HN{=}C(NH_2){-}S{-}(CH_2CH_2O)_4{-}C_8H_{17}$ | 1.0 | 3.77 | −0.02 | −0.27 | −0.58 |
| 8 | $HN{=}C(NH_2){-}S{-}(CH_2CH_2O)_4{-}C_{10}H_{21}$ | 1.0 | 4.83 | −0.03 | −0.43 | −0.47 |
| 9 | 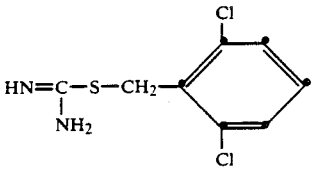 | 1.0 | 3.27 | −0.02 | +0.25 | −0.52 |
| 10 | 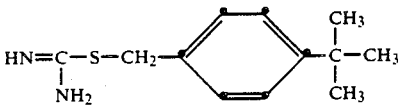 | 1.0 | 3.67 | −0.02 | +0.01 | −0.55 |
| 11 | 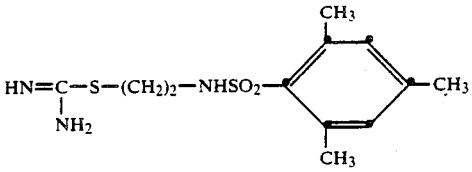 | 1.0 | 2.46 | −0.07 | +0.12 | −0.65 |
| 12 | 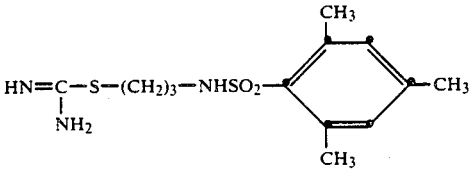 | 1.0 | 2.33 | −0.04 | −0.12 | −0.49 |
| 13 | 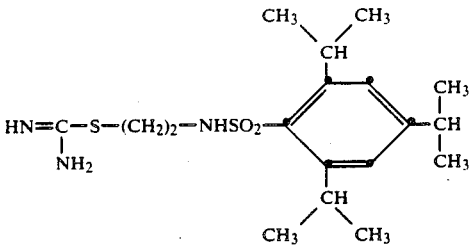 | 1.0<br>1.0<br>0.4 | 5.25 | −0.08<br>−0.09<br>−0.04 | +0.18<br>+0.14<br>+0.02 | −1.18<br>−1.07<br>−0.46 |
| 14 | 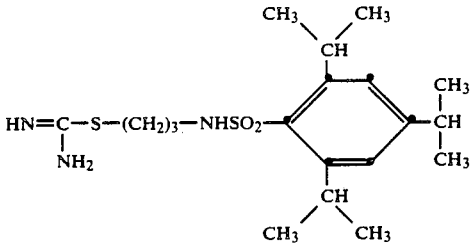 | 1.0<br>0.4 | 5.11 | −0.09<br>−0.05 | +0.11<br>−0.11 | −0.96<br>−0.43 |
| 15 | $HN{=}C(NH_2){-}S{-}(CH_2)_{10}{-}S{-}C(NH_2){=}NH$ | 0.5 | 3.69 | −0.05 | +0.23 | −0.57 |
| 16 | $HN{=}C(NH_2){-}S{-}C_{16}H_{33}$ | 1.0 | 8.02 | −0.07 | −0.18 | −1.46 |

TABLE I-continued

| Example[1] No. | Isothiourea Compound | Concentration (millimoles per mole of silver) | Log P | Delta[2] Log Speed | Delta[3] PDP | Delta[4] Log PF |
|---|---|---|---|---|---|---|
| 17 | $HN{=}\underset{\underset{NH_2}{\vert}}{C}{-}S{-}(CH_2)_{12}{-}S{-}\underset{\underset{NH_2}{\vert}}{C}{=}NH$ | 0.5 | 4.75 | −0.04 | −0.07 | −0.59 |
| A | $HN{=}\underset{\underset{NH_2}{\vert}}{C}{-}S{-}(CH_2)_{10}{-}COOH$ | 1.0 | 3.38 | 0.00 | +0.06 | −0.01 |
| B | $HN{=}\underset{\underset{NH_2}{\vert}}{C}{-}S{-}C_4H_9$ | 1.0 | 1.66 | −0.05 | −0.17 | +0.06 |
| C | $CH_3CH_2N{=}\underset{\underset{HNCH_2CH_3}{\vert}}{C}{-}S{-}C_4H_9$ | 1.0 | 3.8* | +0.01 | −0.05 | +0.05 |
| D | $CH_3CH_2CH_2CH_2N{=}\underset{\underset{HNCH_2CH_2CH_2CH_3}{\vert}}{C}{-}S{-}C_4H_9$ | 1.0 | 5.9* | +0.02 | +0.27 | +0.16 |
| E | $HN{=}\underset{\underset{NH_2}{\vert}}{C}{-}S{-}(CH_2)_2{-}SO_3H$ | 1.0 | −1.09 | 0.00 | −0.10 | −0.45 |
| F | $HN{=}\underset{\underset{NH_2}{\vert}}{C}{-}S{-}(CH_2)_3{-}SO_3H$ | 1.0 | −1.31 | +0.02 | +0.08 | −0.04 |
| G | $HN{=}\underset{\underset{NH_2}{\vert}}{C}{-}S{-}(CH_2)_4{-}SO_3H$ | 1.0 | −0.78 | −0.01 | +0.13 | −0.08 |
| H | $HN{=}\underset{\underset{NH_2}{\vert}}{C}{-}S{-}(CH_2)_2{-}\underset{\underset{CH_3}{\vert}}{CH}{-}SO_3H$ | 1.0 | −1.00 | −0.01 | +0.15 | −0.12 |

[1]A to H are comparison tests for isothiourea compounds outside the scope of the present invention.

[2]DELTA LOG SPEED = $\text{LOG}\,\frac{\text{Control Exposure @ D = 0.6}}{\text{Test Exposure @ D = 0.6}}$

[3]PDP = Practical Density Point = Density at 0.4 log E Past Speed Point

DELTA PDP = Test PDP − Control PDP

[4]DELTA LOG PF = $\text{LOG}\,\frac{\text{Number of PF spots in test}}{\text{Number of PF spots in control}}$ (A Delta Log PF of −1.0 represents a reduction in pepper fog of ten times, while a Delta Log PF of −2.0 represents a reduction in pepper fog of one hundred times.)

*Indicates an estimated value of Log P.

As indicated by the data in Table I, each of the isothiourea compounds employed in Examples 1 to 17 brought about a substantial reduction in the level of pepper fog, reducing the number of pepper fog spots by about three times in the case of the least effective compound (Example 1) and by about one hundred times in the case of the most effective compound (Example 2). These isothiourea compounds had only a minor effect on toe speed, typically about a 0.05 log speed loss, and no significant effect on shoulder density. (The minor increases or decreases in shoulder density reported represent experimental variability).

As also indicated by the data in Table I, the isothioureas employed in comparative tests A to H were generally ineffective for the purpose of reducing pepper fog because of the presence of a solubilizing group and/or the lack of a ballasting group with sufficient bulk to retain the compound in the photographic element during development.

Solubilizing groups such as carboxyl or sulfonate are ionized in the photographic element and the ion pair exhibits a low value of log P. Thus, for example, the compound $$HN{=}\underset{\underset{NH_2}{\vert}}{C}{-}S{-}(CH_2)_{10}{-}COOH$$

employed in control test A has a log P of 3.38 but the ion pair $-(CH_2)_{10}\,COO^{\ominus}\,Na^{+}$ is estimated to have a log P of only 0.2. Thus, this compound does not have the desired hydrophobic property.

While the compound used in control test E provided a significant decrease in pepper fog, it is a highly soluble compound and as a result will wash out of the photographic element and cause seasoning problems in the developing solution. It is believed to decrease pepper fog because it hydrolyzes very rapidly so as to release a significant amount of free mercaptan before it is washed out. The compounds used in control tests F, G and H are less soluble because of the increased length of the alkylene group, but are also much less effective in decreasing pepper fog. Thus, none of compounds A to H are effective for the purposes of this invention.

Certain of the films were analyzed for the effect upon image spread of the incorporated isothiourea compound. The rate of change of halftone dot diameter with processing time was determined by monitoring the change in integrated density of a contact-exposed 10% tint pattern during the first 60 seconds of development and converting the integrated density to equivalent dot size. Dot growth during this period was found to be quite constant, i.e., a plot of dot diameter versus time in linear. The rates of dot diameter growth for the control and for the test films which were analyzed are reported in Table II.

TABLE II

| Example No. | Concentration (millimoles per mole of silver) | Dot Growth Rate (micron/sec) |
|---|---|---|
| Control | — | 0.68 |
| 2 | 1.0 | 0.32 |
| 3 | 1.0 | 0.51 |
| 4 | 1.0 | 0.40 |
| 9 | 1.0 | 0.47 |
| 10 | 1.0 | 0.53 |
| 11 | 1.0 | 0.50 |
| 12 | 1.0 | 0.57 |
| 13 | 1.0 | 0.47 |
| 14 | 1.0 | 0.50 |
| 15 | 0.5 | 0.51 |
| C | 1.0 | 0.62 |
| D | 1.0 | 0.64 |

As indicated by the data in Table II, the isothiourea compounds of this invention reduced the rate of dot growth, typically by 25 percent or more, from the rate of 0.68 micron/second exhibited by the control. In comparison, the compound employed in comparative Test C reduced the growth rate to a level of 0.62 and the compound employed in Comparative Test D reduced the growth rate to 0.64 and were thus much less effective as image spread restrainers.

Use of the ballasted hydrophobic isothiourea compounds of this invention provides a number of important benefits. They provide a means to control both pepper fog and image spread. By their conjoint use with hydrazine compounds that function as nucleating agents and amino compounds that function as incorporated boosters, it is feasible to provide a photographic system with high speed, high contrast, low pepper fog, good discrimination, no significant adverse seasoning effects, good dot quality and minimal chemical spread. These benefits can be achieved with the hydrazine compound, the amino compound and the isothiourea compound all being incorporated in the photographic element so that conventional low cost developing solutions can be employed, and the disadvantages resulting from incorporating amino compounds in the developing solution can be avoided.

The invention has been described in detail with particular reference to certain preferred embodiments thereof, but it will be understood that variations and modifications can be effected within the spirit and scope of the invention.

What is claimed is:

1. A silver halide photographic element adapted to form a high contrast image when development is carried out, in the presence of a hydrazine compound which functions as a nucleating agent, with an aqueous alkaline developing solution; said element comprising an amino compound which functions as an incorporated booster and, in an amount effective to inhibit pepper fog without unduly decreasing speed, contrast, or practical density point, a ballasted hydrophobic isothiourea compound which has a partition coefficient of at least one and which is represented by the formula:

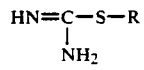

wherein R is a ballasting group containing at least six carbon atoms that is substantially free of solubilizing groups.

2. A photographic element as claimed in claim 1 wherein said ballasted hydrophobic isothiourea compound is represented by the formula:

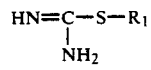

wherein $R_1$ is an alkyl group of 8 to 30 carbon atoms.

3. A photographic element as claimed in claim 1 wherein said ballasted hydrophobic isothiourea compound is represented by the formula:

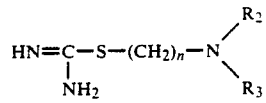

wherein n is 2 to 6 and $R_2$ and $R_3$ are alkyl groups of 2 to 6 carbon atoms.

4. A photographic element as claimed in claim 1 wherein said ballasted hydrophobic isothiourea compound is represented by the formula:

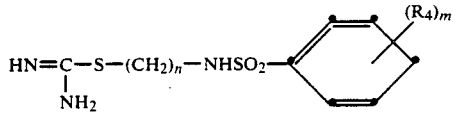

wherein n is 2 to 6, m is 1 to 3, and $R_4$ is alkyl of 1 to 6 carbon atoms.

5. A photographic element as claimed in claim 1 wherein said ballasted hydrophobic isothiourea compound is represented by the formula:

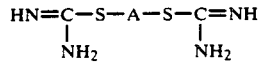

wherein A is an alkylene group of at least six carbon atoms.

6. A photographic element as claimed in claim 1 wherein said ballasted hydrophobic isothiourea compound is

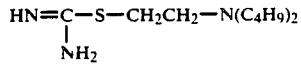

7. A photographic element as claimed in claim 1 wherein said ballasted hydrophobic isothiourea compound is

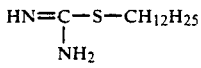

8. A photographic element as claimed in claim 1 wherein said ballasted hydrophobic isothiourea compound is

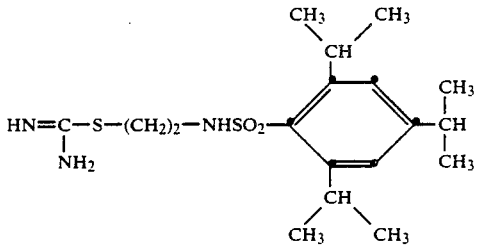

9. A photographic element as claimed in claim 1 wherein said ballasted hydrophobic isothiourea compound is

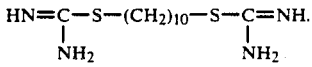

10. A photographic element as claimed in claim 1 wherein said ballasted hydrophobic isothiourea compound is present in said element in an amount of from about 0.1 to about 10 millimoles per mole of silver.

11. A photographic element as claimed in claim 1 wherein said ballasted hydrophobic isothiourea compound is present in said element in an amount of from about 0.5 to about 2 millimoles per mole of silver.

12. A photographic element as claimed in claim 1 wherein said amino compound which functions as an incorporated booster is an amino compound which (1) comprises at least one secondary or tertiary amino group, (2) contains within its structure a group comprised of at least three repeating ethyleneoxy units, and (3) has a partition coefficient of at least one.

13. A photographic element as claimed in claim 1 wherein said hydrazine compound which functions as a nucleating agent is present in said element.

14. A photographic element as claimed in claim 13 wherein said hydrazine compound has the formula:

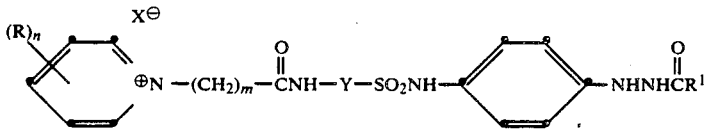

where each R is an alkyl group, n is 1 to 3, X is an anion, m is 1 to 6, Y is a divalent aromatic radical, and $R^1$ is hydrogen or a blocking group.

15. A photographic element as claimed in claim 13 wherein said hydrazine compound has the formula:

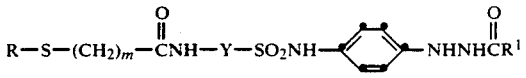

where R is a monovalent group comprised of at least three repeating ethyleneoxy units, m is 1 to 6, Y is a divalent aromatic radical, and $R^1$ is hydrogen or a blocking group.

16. A silver halide photographic element adapted to form a high contrast image upon development with an aqueous alkaline developing solution; said element comprising (1) from about $5\times10^{-4}$ to about $5\times10^{-2}$ moles per mole of silver of a hydrazine compound which functions as a nucleating agent, said hydrazine compound having the formula:

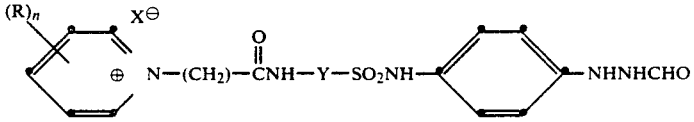

where each R is alkyl of 1 to 12 carbon atoms, n is 1 to 3, X is chloride or bromide, and Y is phenylene;

(2) from about 1 to about 25 millimoles per mole of silver of an amino compound which functions as an incorporated booster, said amino compound having the formula:

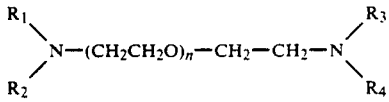

wherein n is an integer with a value of 3 to 50, $R_1$, $R_2$, $R_3$ and $R_4$ are independently alkyl groups of 1 to 8 carbon atoms, $R_1$ and $R_2$ taken together and $R_3$ and $R_4$ taken together represent the atoms necessary to complete a heterocyclic ring, and (3) from about 0.1 to about 10 millimoles per mole of silver of an isothiourea compound which functions as a pepper fog restrainer, said isothiourea compound having a partition coefficient of at least one and the formula:

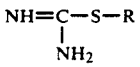

wherein R is a ballasting group that contains at least six carbon atoms, and is substantially free of solubilizing groups.

17. A process for forming a high contrast photographic image which comprises imagewise exposing a silver halide photographic element and developing said exposed element, in the presence of a hydrazine compound which functions as a nucleating agent, with an aqueous alkaline photographic developing solution; said element comprising an amino compound which functions as an incorporated booster and, in an amount effective to inhibit pepper fog without unduly decreasing speed, contrast or practical density point, a ballasted hydrophobic isothiourea compound which has a partition coefficient of at least one and which is represented by the formula:

$$HN{=}\underset{\underset{NH_2}{|}}{C}{-}S{-}R$$

wherein R is a ballasting group containing at least six carbon atoms that is substantially free of solubilizing groups.

18. A process as claimed in claim 17 wherein said ballasted hydrophobic isothiourea compound is $$HN{=}\underset{\underset{NH_2}{|}}{C}{-}S{-}CH_2CH_2{-}N(C_4H_9)_2$$

19. A process as claimed in claim 17 wherein said ballasted hydrophobic isothiourea compound is present in said element in an amount of from about 0.1 to about 10 millimoles per mole of silver.

20. A process as claimed in claim 17 wherein said hydrazine compound which functions as a nucleating agent is present in said element.

21. A process as claimed in claim 17 wherein said developing solution comprises a dihydroxybenzene developing agent.

22. A process as claimed in claim 17 wherein said developing solution comprises a dihydroxybenzene developing agent and an auxiliary super additive developing agent.

23. A process as claimed in claim 17 wherein said developing solution comprises hydroquinone and a 3-pyrazolidone developing agent.

24. A process as claimed in claim 17 wherein said developing solution contains a sulfite preservative.

25. A process as claimed in claim 17 wherein said developing solution contains a benzotriazole antifoggant.

26. A process for forming a high contrast photographic image which comprises image-wise exposing a silver halide photographic element and developing said exposed element with an aqueous alkaline photographic developing solution; said developing solution containing a dihydroxybenzene developing agent, an auxiliary super-additive developing agent and a sulfite preservative; said element containing:

(1) from about $5\times10^{-4}$ to about $5\times10^{-2}$ moles per mole of silver of a hydrazine compound which functions as a nucleating agent, said hydrazine compound having the formula:

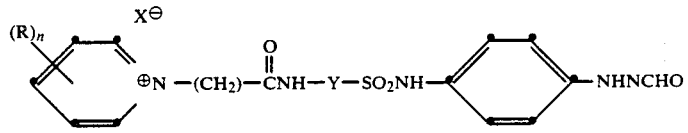

where each R is alkyl of 1 to 12 carbon atoms, n is 1 to 3, X is chloride or bromide, and Y is phenylene;

(2) from about 1 to about 25 millimoles per mole of silver of an amino compound which functions as an incorporated booster, said amino compound having the formula:

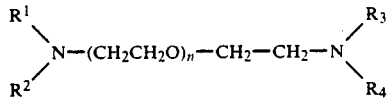

wherein n is an integer with a value of 3 to 50, $R_1$, $R_2$, $R_3$ and $R_4$ are independently alkyl groups of 1 to 8 carbon atoms, $R_1$ and $R_2$ taken together and $R_3$ and $R_4$ taken together represent the atoms necessary to complete a heterocyclic ring, and (3) from about 0.1 to about 10 millimoles per mole of silver of an isothiourea compound which functions as a pepper fog restrainer, said isothiourea compound having a partition coefficient of at least one and the formula:

$$NH{=}\underset{\underset{NH_2}{|}}{C}{-}S{-}R$$

wherein R is a ballasting group which contains at least six carbon atoms and is substantially free of solubilizing groups.

27. A process for forming a high contrast photographic image which comprises imagewise exposing a silver halide photographic element and developing said exposed element with an aqueous alkaline photographic developing solution; said developing solution having a pH in the range of 9 to 10.8 and containing hydroquinone, a 3-pyrazolidone developing agent and a sulfite preservative; said element containing (1) from about $5\times10^{-4}$ to about $5\times10^{-2}$ moles per mole of silver of a hydrazine compound which functions as a nucleating agent, said hydrazine compound having the formula:

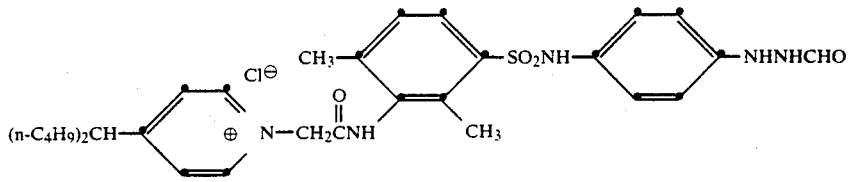

(2) from about 1 to about 25 millimoles per mole of silver of an amino compound which functions as an incorporated booster, said amino compound having the formula:

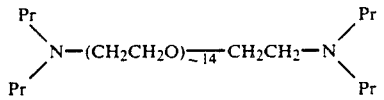

where Pr represents n-propyl, and (3) from about 0.1 to about 10 millimoles per mole of silver of an isothiourea compound which functions as a pepper fog restrainer, said isothiourea compound having the formula:

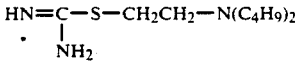

28. A process for forming a high contrast photographic image which comprises imagewise exposing a silver halide photographic element and developing said exposed element with an aqueous alkaline photographic developing solution; said developing solution containing a dihydroxybenzene developing agent, an auxiliary super-additive developing agent and a sulfite preservative; said element containing:

(1) from about $5\times10^{-4}$ to about $5\times10^{-2}$ moles per mole of silver of a hydrazine compound which functions as a nucleating agent, said hydrazine compound having the formula:

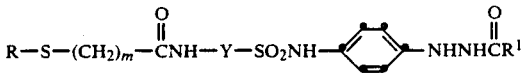

where R is a monovalent group comprised of at least three repeating ethyleneoxy units, m is 1 to 6, Y is a divalent aromatic radical, and $R^1$ is hydrogen or a blocking group;

(2) from about 1 to about 25 millimoles per mole of silver of an amino compound which functions as an incorporated booster, said amino compound having the formula:

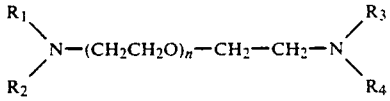

wherein n is an integer with a value of 3 to 50, $R_1$, $R_2$, $R_3$ and $R_4$ are independently alkyl groups of 1 to 8 carbon atoms, $R_1$ and $R_2$ taken together and $R_3$ and $R_4$ taken together represent the atoms necessary to complete a heterocyclic ring, and (3) from about 0.1 to about 10 millimoles per mole of silver of an isothiourea compound which functions as a pepper fog restrainer, said isothiourea compound having a partition coefficient of at least one and the formula:

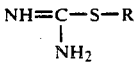

wherein R is a ballasting group which contains at least six carbon atoms and is substantially free of solubilizing groups.

* * * * *